US008220957B2

(12) United States Patent
Lydecker et al.

(10) Patent No.: US 8,220,957 B2
(45) Date of Patent: Jul. 17, 2012

(54) RETROFIT LIGHT ASSEMBLY

(75) Inventors: Stephen Haight Lydecker, Snellville, GA (US); John T. Mayfield, III, Loganville, GA (US); Mark E. Nicholson, Covington, GA (US); Russell Vern Rouse, Oxford, GA (US); Peter M. Schmidt, Conyers, GA (US); Stephan Barry McCane, McDonough, GA (US)

(73) Assignee: ABL IP Holding LLC, Conyers, GA (US)

( * ) Notice: Subject to any disclaimer, the term of this patent is extended or adjusted under 35 U.S.C. 154(b) by 605 days.

(21) Appl. No.: 12/416,617

(22) Filed: Apr. 1, 2009

(65) Prior Publication Data

US 2009/0207603 A1 Aug. 20, 2009

Related U.S. Application Data

(63) Continuation-in-part of application No. 11/706,467, filed on Feb. 12, 2007, now Pat. No. 7,635,198.

(60) Provisional application No. 61/041,389, filed on Apr. 1, 2008.

(51) Int. Cl.
*F21V 21/00* (2006.01)

(52) U.S. Cl. ..... 362/222; 362/223; 362/217.01; 362/217.02

(58) Field of Classification Search ..... 362/217.01, 362/222, 223, 217.02–217.05
See application file for complete search history.

(56) References Cited

U.S. PATENT DOCUMENTS 1,900,551 A 3/1933 Guth
D122,861 S 10/1940 Carter
D128,961 S 8/1941 Hrabak
2,258,354 A 10/1941 Doane
D132,144 S 4/1942 Hallman
2,281,376 A 4/1942 Ohm
2,334,005 A 11/1943 Hoeveler
(Continued)

FOREIGN PATENT DOCUMENTS

CA 123993 11/2008
(Continued)

OTHER PUBLICATIONS

Non-Final Office Action dated Sep. 29, 2010 in U.S. Appl. No. 29/307,511.
A.L.P. Lighting Components, Inc., "Convert-A-Strip", 1999, pp. 1-2.
A.L.P. Lighting Components, Inc., "Guide to Lighting Retrofit", 2005, pp. 1-31.
Alter, "Lighting 1994-1995", 1994, pp. 1-6.
(Continued)

*Primary Examiner* — Anabel Ton
(74) *Attorney, Agent, or Firm* — Kilpatrick Townsend & Stockton LLP

(57) ABSTRACT

Retrofit systems for replacing the outdated components of an existing light fixture. The retrofit systems may utilize the previously installed housing of the existing light fixture. The retrofit systems include brackets that are positioned on the ends of the housing. The positioning of the brackets is based off of the ceiling, t-grid, or the bottom of the housing. Lamp sockets with associated lamps, an optional ballast tray with associated ballast, reflector(s), lamps, and a shielding mechanism are all mounted on, and their position in the housing dictated by, the mounting brackets. Thus, regardless of the depth of the housing, the lamps are positioned a uniform distance from the ceiling opening to create consistent light distribution. Moreover, because these components are not directly attached to the housing, their dimensions need not precisely match those of the housing. Rather, the retrofit system can be installed in housings of varying sizes and shapes.

27 Claims, 38 Drawing Sheets

U.S. PATENT DOCUMENTS

| | | | | |
|---|---|---|---|---|
| D143,641 | S | | 1/1946 | Biller et al. |
| D155,306 | S | | 9/1949 | Meyer |
| D156,332 | S | | 12/1949 | Gilman |
| 2,490,018 | A | | 12/1949 | Davis |
| D156,765 | S | | 1/1950 | Quin |
| D160,417 | S | | 10/1950 | Nitardy |
| 2,565,741 | A | | 8/1951 | Runge |
| 2,597,739 | A | | 5/1952 | Lacy et al |
| 2,606,998 | A | | 8/1952 | Wyman et al. |
| 2,625,646 | A | | 1/1953 | Goebel |
| 2,670,429 | A | | 2/1954 | Tillson |
| 2,701,840 | A | | 2/1955 | Carlson |
| D177,268 | S | | 3/1956 | McCormack |
| 2,852,663 | A | | 9/1958 | Stuffer et al. |
| 2,946,880 | A | | 7/1960 | Picho et al. |
| 2,971,083 | A | | 2/1961 | Phillips et al. |
| 3,004,147 | A | | 10/1961 | Kochale et al. |
| 3,009,054 | A | | 11/1961 | Thomas |
| 3,052,372 | A | | 9/1962 | Shepherd |
| 3,152,277 | A | | 10/1964 | Cutler et al. |
| 3,154,001 | A | | 10/1964 | Zurawski |
| 3,265,887 | A | | 8/1966 | Wince |
| 3,281,588 | A | | 10/1966 | Spinetta |
| D209,534 | S | | 12/1967 | Eisenberg |
| 3,381,124 | A | | 4/1968 | Eisenberg |
| 3,748,460 | A | | 7/1973 | Price |
| 3,755,667 | A | | 8/1973 | Price |
| 3,790,774 | A | | 2/1974 | Miller et al. |
| 3,838,268 | A | | 9/1974 | Fabbri |
| D240,853 | S | | 8/1976 | Aronson |
| D247,061 | S | | 1/1978 | Win |
| 4,135,228 | A | | 1/1979 | Lones |
| 4,220,986 | A | | 9/1980 | Matteo et al. |
| 4,229,785 | A | | 10/1980 | Tuller |
| 4,268,897 | A | | 5/1981 | Schierwagen et al. |
| 4,317,625 | A | | 3/1982 | Van Allen |
| 4,338,663 | A | | 7/1982 | Strecker et al. |
| 4,429,354 | A | | 1/1984 | Garnett |
| D275,264 | S | | 8/1984 | Wegener, II et al. |
| D275,553 | S | | 9/1984 | Emmie et al. |
| 4,494,175 | A | | 1/1985 | Gawad et al. |
| 4,498,126 | A | | 2/1985 | Hernandez |
| 4,554,619 | A | | 11/1985 | Bansbach et al. |
| D285,047 | S | | 8/1986 | Dean et al. |
| 4,613,929 | A | * | 9/1986 | Totten ..... 362/150 |
| 4,650,265 | A | | 3/1987 | Holtzman |
| 4,674,015 | A | | 6/1987 | Smith |
| 4,690,359 | A | | 9/1987 | Phillips |
| 4,698,734 | A | | 10/1987 | Ngai |
| 4,725,934 | A | | 2/1988 | Gordin |
| 4,748,545 | A | | 5/1988 | Schmitt |
| 4,799,136 | A | | 1/1989 | Molnar |
| D300,873 | S | | 4/1989 | Thompson et al. |
| 4,849,867 | A | | 7/1989 | Glass et al. |
| 4,947,303 | A | | 8/1990 | Gordin et al. |
| 4,950,959 | A | | 8/1990 | Beckrot et al. |
| 4,956,758 | A | | 9/1990 | Aubrey et al. |
| 4,967,324 | A | | 10/1990 | Barclay |
| 4,977,490 | A | | 12/1990 | Davies |
| 5,029,794 | A | | 7/1991 | Wolfe |
| D320,094 | S | | 9/1991 | Miller et al. |
| 5,045,981 | A | | 9/1991 | Nagano |
| 5,055,976 | A | | 10/1991 | Arai |
| 5,075,828 | A | | 12/1991 | Gordin et al. |
| 5,083,248 | A | | 1/1992 | Troy |
| 5,117,342 | A | | 5/1992 | Vlah |
| D329,102 | S | | 9/1992 | Dieperink |
| D334,076 | S | | 3/1993 | Dieperink et al. |
| 5,195,822 | A | | 3/1993 | Takahashi et al. |
| 5,303,507 | A | | 4/1994 | Oille |
| 5,365,411 | A | | 11/1994 | Rycroft et al. |
| D357,607 | S | | 4/1995 | Nilsson |
| 5,412,551 | A | | 5/1995 | Newell |
| D360,271 | S | | 7/1995 | Butler |
| D361,402 | S | | 8/1995 | Herst et al. |
| 5,440,466 | A | | 8/1995 | Belisle et al. |
| 5,440,470 | A | | 8/1995 | Ly |
| D365,409 | S | | 12/1995 | Lu |
| 5,550,723 | A | | 8/1996 | Ullman |
| D374,579 | S | | 10/1996 | Nilsson |
| D376,094 | S | | 12/1996 | Hubbard |
| 5,580,158 | A | | 12/1996 | Aubrey et al. |
| D377,231 | S | | 1/1997 | Degelmann |
| 5,606,222 | A | | 2/1997 | Cottaar et al. |
| D378,860 | S | | 4/1997 | Galletly |
| 5,615,943 | A | | 4/1997 | Coldren |
| 5,621,277 | A | | 4/1997 | Ricca |
| D383,966 | S | | 9/1997 | Zaccagni |
| 5,695,358 | A | | 12/1997 | Myer et al. |
| 5,716,125 | A | | 2/1998 | Aubrey |
| 5,746,502 | A | | 5/1998 | Huang |
| D397,819 | S | | 9/1998 | Thorton |
| 5,803,585 | A | | 9/1998 | Littman et al. |
| 5,806,972 | A | | 9/1998 | Kaiser et al. |
| 5,823,663 | A | | 10/1998 | Bell et al. |
| 5,826,970 | A | | 10/1998 | Keller et al. |
| 5,828,185 | A | | 10/1998 | Fellows et al. |
| 5,836,677 | A | | 11/1998 | Connors et al. |
| 5,938,316 | A | | 8/1999 | Yan |
| 5,949,347 | A | | 9/1999 | Wu |
| 5,971,571 | A | | 10/1999 | Rose |
| 5,988,829 | A | | 11/1999 | Holder |
| 5,988,836 | A | | 11/1999 | Swarens |
| 5,997,158 | A | | 12/1999 | Fischer et al. |
| 5,998,939 | A | | 12/1999 | Fellows et al. |
| 6,010,230 | A | | 1/2000 | Schmidt et al. |
| 6,024,468 | A | | 2/2000 | Kassay et al. |
| 6,050,709 | A | | 4/2000 | Hastings |
| 6,059,424 | A | | 5/2000 | Kotloff |
| 6,062,704 | A | | 5/2000 | Holder |
| 6,102,550 | A | | 8/2000 | Edwards |
| 6,107,744 | A | | 8/2000 | Bavaro et al. |
| 6,149,280 | A | | 11/2000 | Quioque et al. |
| 6,164,800 | A | | 12/2000 | McIlwraith |
| 6,168,299 | B1 | | 1/2001 | Yan |
| 6,168,300 | B1 | | 1/2001 | Fischer et al. |
| 6,174,069 | B1 | | 1/2001 | Plunk |
| 6,206,545 | B1 | | 3/2001 | Yan |
| D440,341 | S | | 4/2001 | Arumugasaamy |
| 6,210,019 | B1 | | 4/2001 | Weathers |
| 6,210,025 | B1 | | 4/2001 | Schmidt et al. |
| 6,234,641 | B1 | | 5/2001 | Ungard |
| 6,234,643 | B1 | | 5/2001 | Lichon |
| 6,238,065 | B1 | | 5/2001 | Jones |
| 6,273,592 | B1 | | 8/2001 | Herst et al. |
| 6,280,052 | B1 | | 8/2001 | White |
| 6,301,770 | B1 | | 10/2001 | McIlwraith |
| 6,305,816 | B1 | | 10/2001 | Corcorran et al. |
| 6,367,179 | B1 | | 4/2002 | Marsh |
| 6,419,375 | B1 | | 7/2002 | Leadford et al. |
| 6,422,720 | B2 | | 7/2002 | Fischer et al. |
| D461,267 | S | | 8/2002 | Arumugasaamy |
| 6,454,442 | B1 | | 9/2002 | Changaris |
| 6,485,166 | B1 | | 11/2002 | Fouke |
| D467,676 | S | | 12/2002 | Packer et al. |
| D467,677 | S | | 12/2002 | Ries et al. |
| 6,505,953 | B1 | | 1/2003 | Dahlen |
| 6,505,959 | B2 | | 1/2003 | Masaki et al. |
| 6,530,681 | B2 | | 3/2003 | Sieczkowski |
| 6,537,649 | B1 | | 3/2003 | Martin et al. |
| D472,665 | S | | 4/2003 | Herst et al. |
| D472,666 | S | | 4/2003 | Herst et al. |
| D472,667 | S | | 4/2003 | Herst et al. |
| D472,668 | S | | 4/2003 | Herst et al. |
| D473,007 | S | | 4/2003 | Herst et al. |
| D473,335 | S | | 4/2003 | Brohard et al. |
| 6,540,382 | B1 | | 4/2003 | Simon |
| 6,582,098 | B1 | | 6/2003 | Brown et al. |
| D477,891 | S | | 7/2003 | Fritze et al. |
| D480,168 | S | | 9/2003 | Herst et al. |
| D480,172 | S | | 9/2003 | Herst et al. |
| 6,612,718 | B1 | | 9/2003 | Packer et al. |
| 6,612,723 | B2 | | 9/2003 | Futhey et al. |
| D480,500 | S | | 10/2003 | Herst et al. |
| D480,501 | S | | 10/2003 | Herst et al. |
| D480,502 | S | | 10/2003 | Herst et al. |
| D480,503 | S | | 10/2003 | Herst et al. |

| | | | | |
|---|---|---|---|---|
| D480,530 | S | 10/2003 | Herst et al. | |
| D480,830 | S | 10/2003 | Sieczkowski | |
| D481,488 | S | 10/2003 | Herst et al. | |
| D481,489 | S | 10/2003 | Cline et al. | |
| 6,635,999 | B2 | 10/2003 | Belliveau | |
| 6,637,912 | B2 | 10/2003 | Arumugasaamy et al. | |
| D481,820 | S | 11/2003 | Watt | |
| 6,652,118 | B2 | 11/2003 | Shemitz et al. | |
| D483,510 | S | 12/2003 | Burhenne et al. | |
| 6,655,819 | B2 | 12/2003 | Loga et al. | |
| D485,932 | S | 1/2004 | Crane | |
| 6,690,113 | B1 | 2/2004 | Ng | |
| D487,527 | S | 3/2004 | Sieczkowski | |
| 6,709,131 | B1 | 3/2004 | Herst et al. | |
| 6,715,903 | B2 | 4/2004 | Wang | |
| 6,726,345 | B2 | 4/2004 | Arumugusaamy et al. | |
| 6,752,513 | B2 | 6/2004 | Plunk | |
| 6,755,559 | B2 | 6/2004 | Wang et al. | |
| 6,758,580 | B1 | 7/2004 | Verfuerth | |
| 6,853,151 | B2 | 2/2005 | Leong et al. | |
| 6,854,860 | B2 | 2/2005 | Plunk | |
| 6,869,205 | B1 | 3/2005 | Yan | |
| 6,908,212 | B2 | 6/2005 | Schultz | |
| 6,964,502 | B1 | 11/2005 | Verfuerth | |
| 6,974,233 | B1 | 12/2005 | Aubrey | |
| 7,001,039 | B1 | 2/2006 | Aubrey | |
| D520,176 | S | 5/2006 | Herst et al. | |
| 7,036,957 | B2 | 5/2006 | Paravantsos | |
| 7,042,173 | B2 | 5/2006 | Huber | |
| 7,049,761 | B2 | 5/2006 | Timmermans et al. | |
| 7,063,445 | B2 | 6/2006 | Wang et al. | |
| 7,067,992 | B2 | 6/2006 | Leong et al. | |
| 7,075,253 | B2 | 7/2006 | Huber | |
| 7,080,923 | B2 | 7/2006 | Plunk et al. | |
| 7,101,056 | B2 | 9/2006 | Pare | |
| 7,108,398 | B2 | 9/2006 | Holten | |
| 7,121,689 | B2 | 10/2006 | Fowler, Jr. | |
| 7,195,372 | B2 | 3/2007 | Plunk | |
| 7,229,192 | B2 * | 6/2007 | Mayfield et al. | 362/223 |
| 7,261,435 | B2 * | 8/2007 | Gould et al. | 362/223 |
| D556,560 | S | 12/2007 | Tsuda | |
| D586,948 | S | 2/2009 | Mayfield et al. | |
| D594,590 | S | 6/2009 | Mayfield et al. | |
| 7,667,137 | B1 | 2/2010 | Beckman | |
| D612,534 | S | 3/2010 | Mayfield | |
| 7,842,884 | B2 | 11/2010 | Johnson | |
| 7,952,022 | B2 | 5/2011 | Rippel et al. | |
| D640,825 | S | 6/2011 | Schmidt et al. | |
| 7,989,696 | B2 | 8/2011 | Shi et al. | |
| 2001/0006463 | A1 | 7/2001 | Fischer et al. | |
| 2001/0050850 | A1 | 12/2001 | Plunk | |
| 2002/0015301 | A1 | 2/2002 | Woolston et al. | |
| 2002/0080615 | A1 | 6/2002 | Marshall et al. | |
| 2002/0195953 | A1 | 12/2002 | Belliveau | |
| 2004/0042218 | A1 | 3/2004 | Wang et al. | |
| 2004/0105259 | A1 | 6/2004 | Plunk | |
| 2004/0114363 | A1 | 6/2004 | Crunk | |
| 2004/0232852 | A1 | 11/2004 | Huber | |
| 2004/0232856 | A1 | 11/2004 | Huber | |
| 2005/0201094 | A1 | 9/2005 | Plunk | |
| 2006/0018116 | A1 | 1/2006 | Plunk et al. | |
| 2006/0170376 | A1 | 8/2006 | Piepgras et al. | |
| 2007/0008716 | A1 | 1/2007 | Glickman | |
| 2007/0025709 | A1 | 2/2007 | Gladnick et al. | |
| 2007/0127234 | A1 | 6/2007 | Jervey, III | |
| 2007/0177390 | A1 | 8/2007 | Evans | |
| 2007/0189026 | A1 | 8/2007 | Chemel et al. | |
| 2007/0211457 | A1 | 9/2007 | Mayfield et al. | |
| 2007/0228999 | A1 | 10/2007 | Kit | |
| 2007/0297181 | A1 | 12/2007 | Mayfield et al. | |
| 2008/0278943 | A1 | 11/2008 | Van Der Poel | |
| 2009/0207603 | A1 | 8/2009 | Lydecker et al. | |
| 2009/0244908 | A1 | 10/2009 | Lydecker et al. | |
| 2009/0244912 | A1 | 10/2009 | Lydecker et al. | |

FOREIGN PATENT DOCUMENTS

| | | |
|---|---|---|
| GB | 2060212 | 2/1997 |
| GB | 2091915 | 4/2000 |
| JP | 10321009 | 12/1998 |
| JP | 2001307504 | 11/2001 |
| JP | 2005343339 | 12/2005 |

OTHER PUBLICATIONS

CFI Fluorescent, "Alter Soft Lights", 1996 , pp. 1-8.
Columbia Lighting, "Stratus STR 14-2", 1998 , pp. 1-9.
Cooper Lighting, "Metalux", 1999 , pp. 1-8.
Day-Brite Lighting, "Parabolic Retrofit", Installation Instructions, No. 7-19789-103, Oct. 15, 2008 , 2 pages.
Day-Brite Lighting, "Troffer/Parabolic Retrofit", Job Information Data, No. NA-0018-TR, Aug. 1, 2008 , 2 pages.
Focal Point LLC, "Luna", 1997 , pp. 1-5.
Kwik-Change Products, "KC 2000 Series", A.L.P. Lighting Components, Inc. 2004.
Kwik-Change Products, "KC ACR Series", A.L.P. Lighting Components, Inc. 2004.
Kwik-Change Products, "KC RDI", A.L.P. Lighting Components, Inc. 2003.
Kwik-Change Products, "KC-PLNAB 2-3/8" Series", A.L.P. Lighting Components, Inc. 2002.
Kwik-Change Products, "KC-PLTA 2 Series", A.L.P. Lighting Components, Inc. 1999.
Kwik-Fit Products, "Kwik-Fit PLLA 1-1/2"", A.L.P. Lighting Components, Inc. 1999.
Kwik-Fit Products, "Kwik-Fit PLMA 3/4"", A.L.P. Lighting Components, Inc. 1999.
Ledalite Architectural Products, "Pure FX With Mesooptics", a Genlyte Company , pp. 1-15.
Lightolier,, A Division of Genlyte/Thomas "Alter Soft Lights", 2003, pp. 1-67.
Lithonia Lighting, an Acuity Brands Company, Architectural Fluorescent Recessed Direct/Indirect Lighting 1999 , pp. 1-13.
Lithonia Lighting, an Acuity Brands Company, Product Selection Guide, 8th Edition 2003 , pp. 1-620.
Lithonia Lighting, an Acuity Brands Company, Direct/Indirect Lighting 2002 , pp. 1-15.
Lithonia Lighting, an Acuity Brands Company, Avante, Recessed Direct/Indirect Lighting 1996 , pp. 1-4.
Lithonia Lighting, an Acuity Brands Company, Avante, Direct/Indirect General Lighting System 1996 , 2 pages.
Peerless-Lighting, "Parallels", 2005 , pp. 1-2.
Sylvania Lighting International, "Recessed Luminaires", Neuheiten/News , pp. 1-6.
Response to Office Action for Application No. 29/307,511, filed Dec. 22, 2010.
Notice of Allowance for U.S. Appl. No. 29/307,511, mailed Apr. 11, 2011.
Non-Final Office Action for U.S. Appl. No. 29/307,500, mailed Feb. 5, 2009.
Supplemental Notice of Allowability for a Design Application for U.S. Appl. No. 29/307,508, mailed Feb. 2, 2010.
Notice of Allowance for U.S. Appl. No. 29/307,508, mailed Jul. 2, 2009.
Notice of Allowance for U.S. Appl. No. 29/307,508, mailed Nov. 18, 2009.
Non-Final Office action for U.S. Appl. No. 12/416,586, mailed Dec. 23, 2010.
Amendment and Response for U.S. Appl. No. 12/416,586, filed Apr. 18, 2011.
Final Office Action for U.S. Appl. No. 12/416,586, mailed Jul. 19, 2011.
Amendment and Response for U.S. Appl. No. 12/416,586, filed Nov. 17, 2011.
Notice of Allowance for U.S. Appl. No. 12/416,557, mailed Oct. 25, 2011.
*Ex Parte Quayle* for U.S. Appl. No. 12/416,557, mailed Aug. 17, 2011.
Amendment and Response to *Ex Parte Qualyle* Action for U.S. Appl. No. 12/416,557, filed Oct. 17, 2011.

* cited by examiner

RETROFIT LIGHT ASSEMBLY

CROSS REFERENCE TO RELATED APPLICATIONS

This application is a continuation-in-part of U.S. patent application Ser. No. 11/706,467, entitled "Replacement Light Fixture and Lens Assembly for Same," filed on Feb. 12, 2007, and claims the benefit of U.S. provisional application Ser. No. 61/041,389, entitled "Systems and Methods for Universal Retrofitting of a Light Fixture", filed Apr. 1, 2008, the entire contents of each of which are hereby incorporated by these references.

FIELD OF THE INVENTION

Embodiments of the invention generally relate to light fixtures and components used to retrofit existing light fixtures.

BACKGROUND OF THE INVENTION

Energy efficiency and environmental impact have become areas of great concern for society. Commercial entities and concerned individuals continue to look for ways to reduce their energy consumption as well as their carbon footprint. Replacing outdated lighting fixtures can reduce both.

Old lighting fixtures are not as efficient as newer ones. The older lighting fixtures, especially fixtures used in traditional retail and office space, are designed to use fluorescent lamps that have a higher energy consumption rate than the more efficient fluorescent lamps available today. The older lighting fixtures also distribute light inefficiently. Traditional lighting fixtures use direct light to light areas. However, direct light can leave areas devoid of light and create shadows. Therefore, these older fixtures have traditionally included more lamps to generate more light to eliminate these shadows, which increases the energy consumption. Even with more lamps used, shadows still exist, creating a less than aesthetically pleasing environment. However, a mixing of indirect light with the direct light can produce uniform light distribution. Therefore, ensuring that there is a proper mixture of direct and indirect light can eliminate many of the shadows created with only direct lighting.

Replacing the old fixtures with more efficient fixtures, however, creates several problems. Replacing the entire fixture is costly and time consuming. In many applications, full access to the ceiling above the fixture is necessary. Therefore, removal and replacement of ceiling components, such as tiles and t-supports, is required to replace the entire fixture. Exposure to the ceiling environment is less than desirable for a variety of reasons. Environmental concerns, such as asbestos contamination and asbestos removal, become an issue when disturbing the ceiling. Moreover, the area above the ceiling collects dirt and dust which can dislodge during fixture replacement and thereby increase the time and cost of clean-up after installation. Additionally, exposed electrical wiring is common in such areas, which creates a safety hazard for workers removing old fixtures. A licensed electrician may be required to install the new fixtures based upon common safety codes.

Most replacement fixtures require replacing the entire fixture, including the housing and the internal fixture components. An alternative to removing the entire fixture is to leave the housing of the fixture installed in the ceiling and only replace the fixture's internal components, thereby eliminating the need for ceiling access. However, light fixture housings, even ones from the same manufacturer, do not have uniform dimensions. Consequently, traditional retrofits have to use components specifically sized and shaped to fit into a specific existing housing. A retrofit that works with one fixture likely will not work with another fixture and thus a retrofit system must be provided for each fixture type. Additionally, the internal components of existing retrofits are attached and aligned with respect to the inner surface of the existing light fixture housings. Because the depths and other dimensions of light fixture housings vary, the light distribution, and more specifically the mixture of direct and indirect light, can vary from housing to housing, requiring the installer to adjust the retrofit components until the desired distribution is achieved. Therefore, there is a need for a retrofit lighting fixture system for updating less efficient fixtures that is universal in that the system can be installed in a variety of existing light fixture housings while delivering a uniform distribution and mixture of direct and indirect light.

SUMMARY OF EMBODIMENTS OF THE INVENTION

Embodiments of this invention provide a retrofit system for replacing the outdated components of an existing light fixture. The retrofit system utilizes the previously installed housing of the existing light fixture, eliminating the need for an installer to replace the housing. The retrofit system includes brackets that are positioned on the ends of the housing. The positioning of the brackets is based off of the ceiling, t-grid, or the bottom of the housing. Lamp sockets with associated lamps, an optional ballast tray with associated ballast, reflector(s), lamps, and a shielding mechanism such as a louver or lens assembly are all mounted on, and their position in the housing dictated by, the mounting brackets. Thus, regardless of the depth of the housing, the lamps are positioned a uniform distance from the ceiling opening to create consistent light distribution. Moreover, because these components are not directly attached to the housing, their dimensions need not precisely match those of the housing. Rather, the retrofit system can be installed in housing of varying sizes and shapes.

Figure 6:
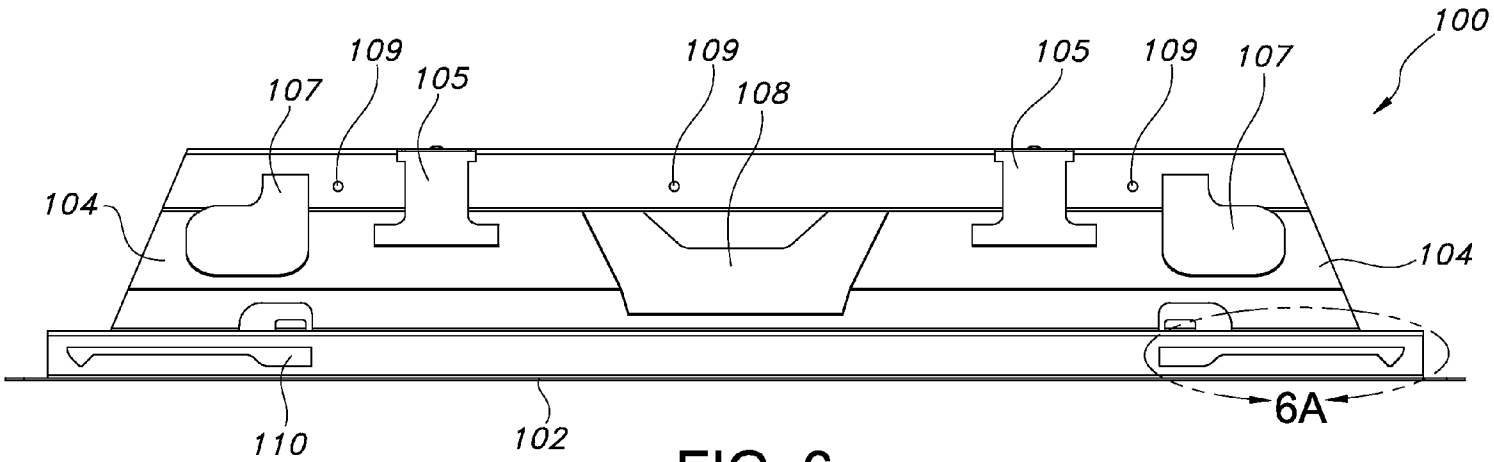
FIG. 6 is a front elevation view of the bracket of FIG. 4.

FIG. **6*a* is an enlarged section view taken at inset circle 6*a* in FIG. 6**.

Figure 4:
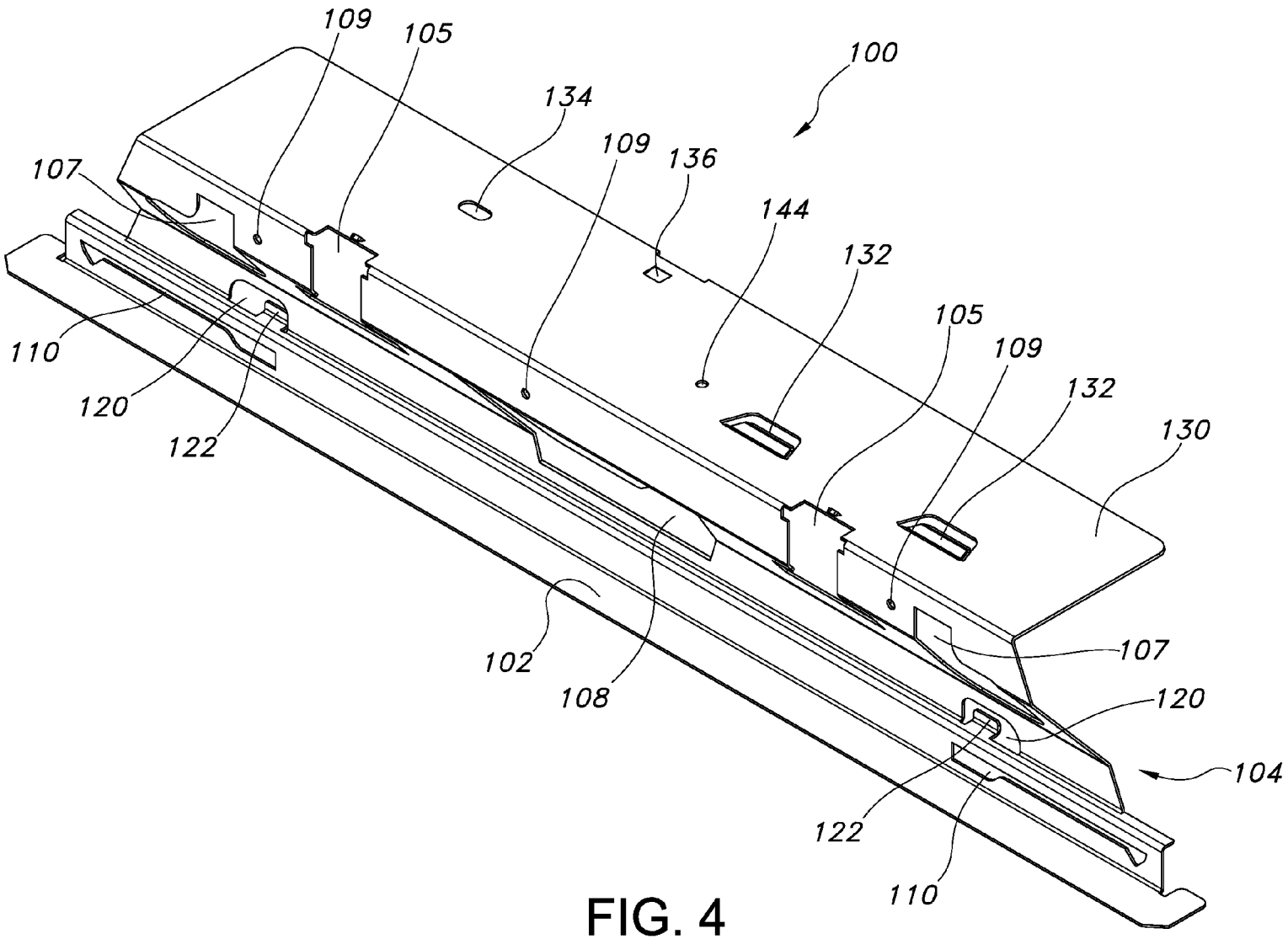
FIG. 4 is a perspective view of one embodiment of a bracket of a retrofit system.
Figure 7:
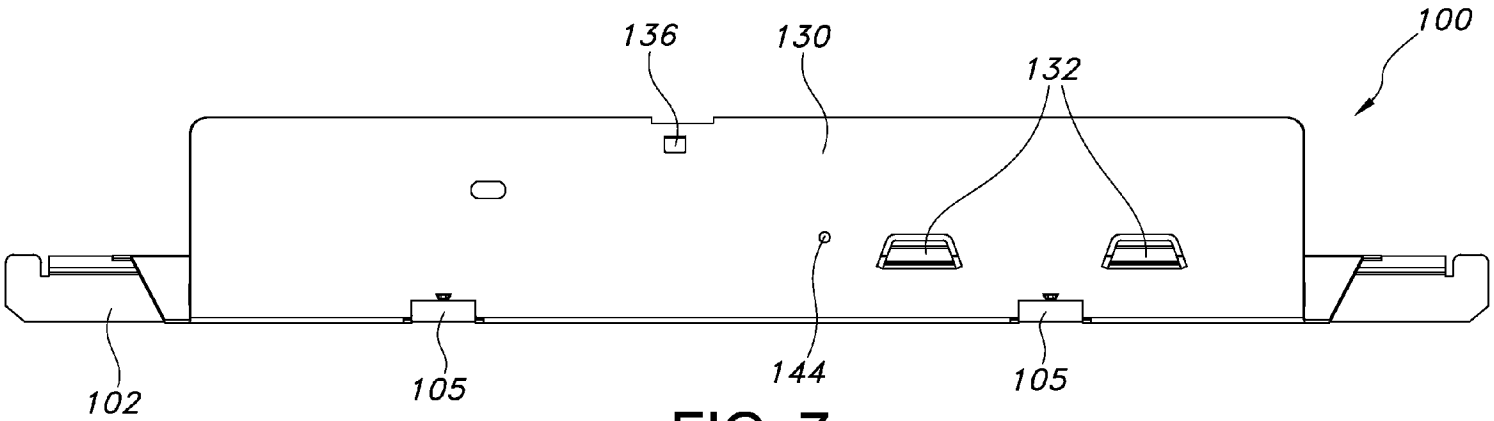

FIG. 7 is a top plan view of the bracket of FIG. 4.

Figure 8:
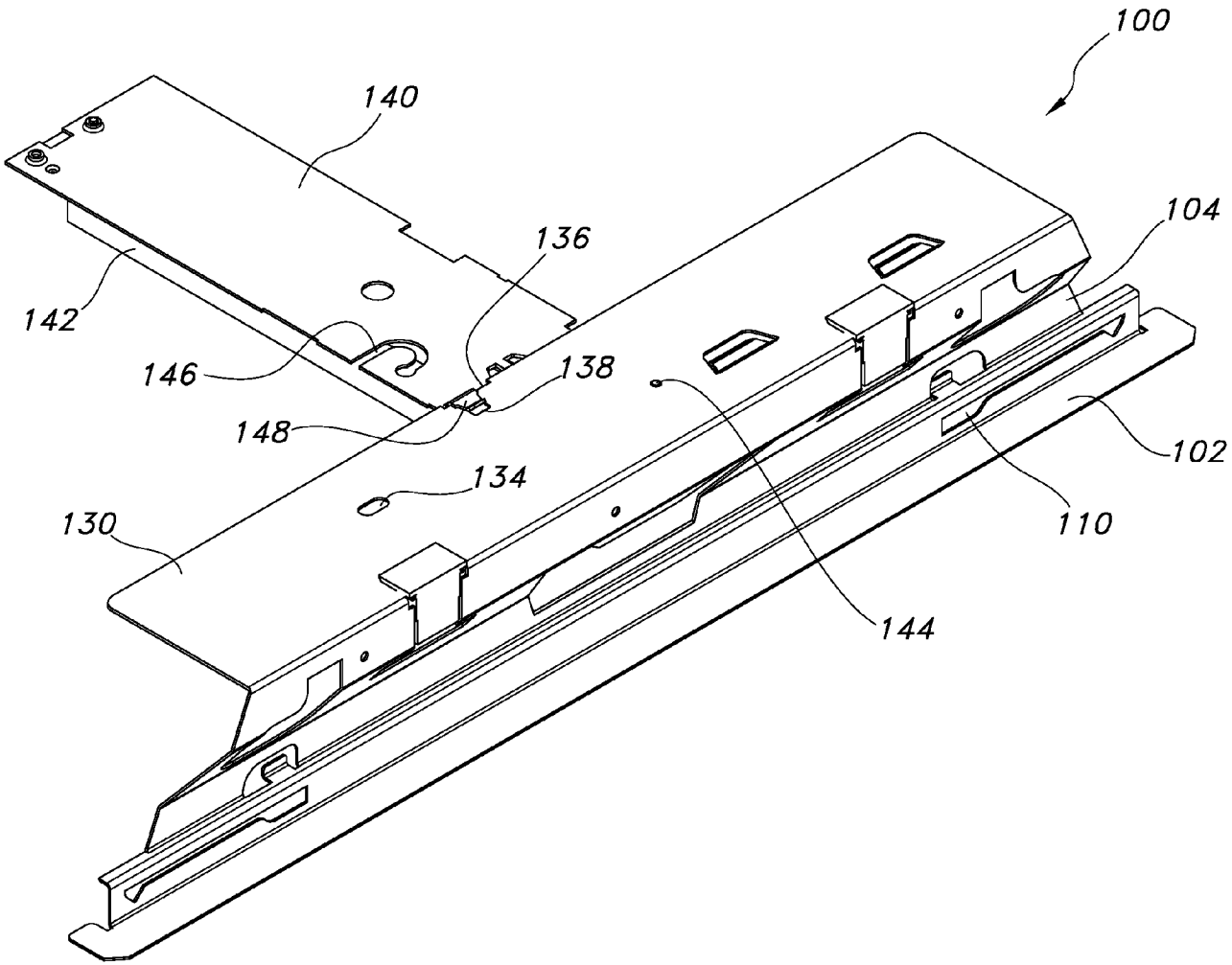

FIG. 8 is a top perspective view of the bracket of FIG. 4 with an associated ballast tray with ballast according to one embodiment of this invention.

Figure 9:
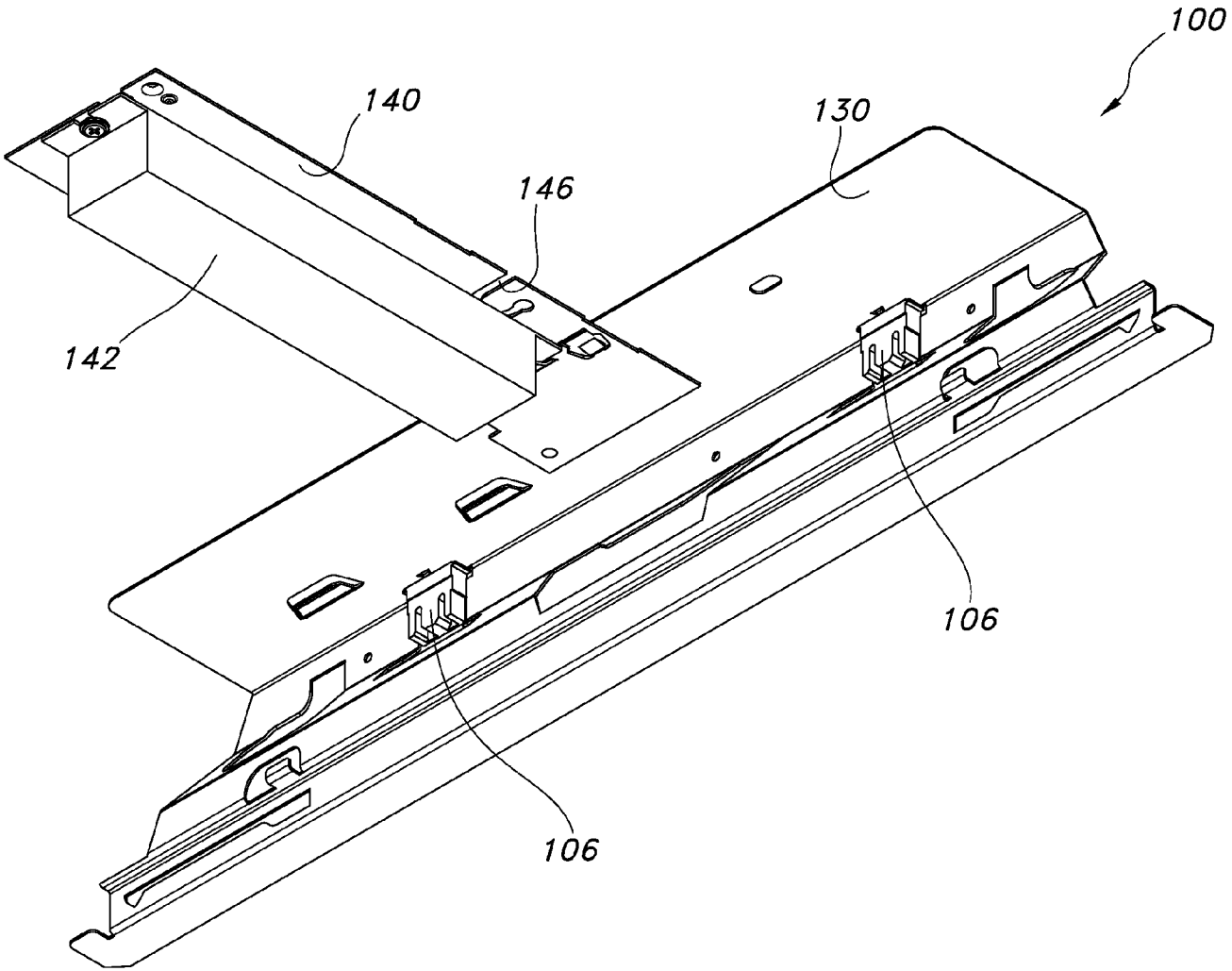

FIG. 9 is a bottom perspective view of the bracket and ballast tray with ballast of FIG. 8.

Figure 10:
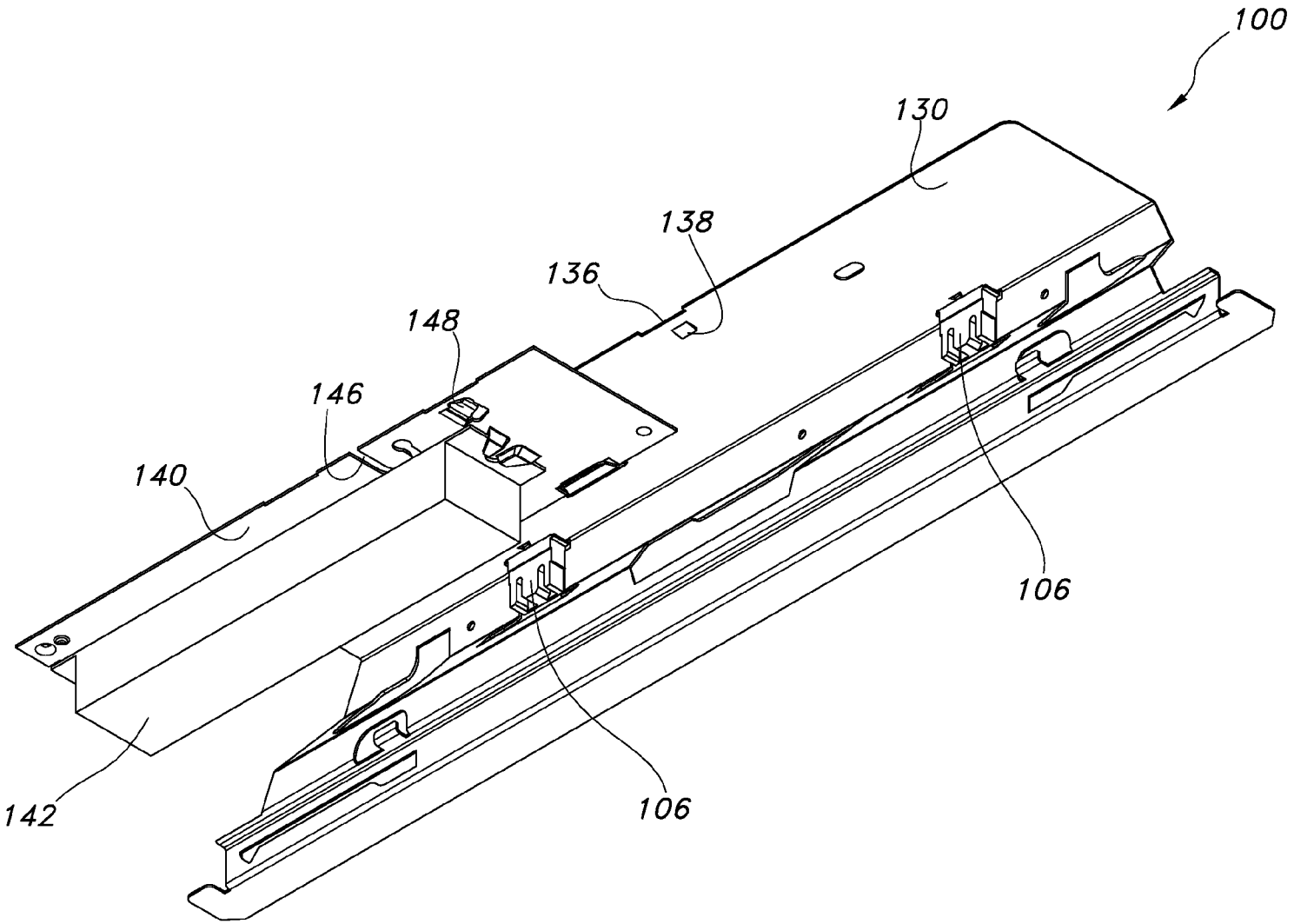

FIG. 10 is another bottom perspective view of the bracket and ballast tray with ballast of FIG. 9.

Figure 11:
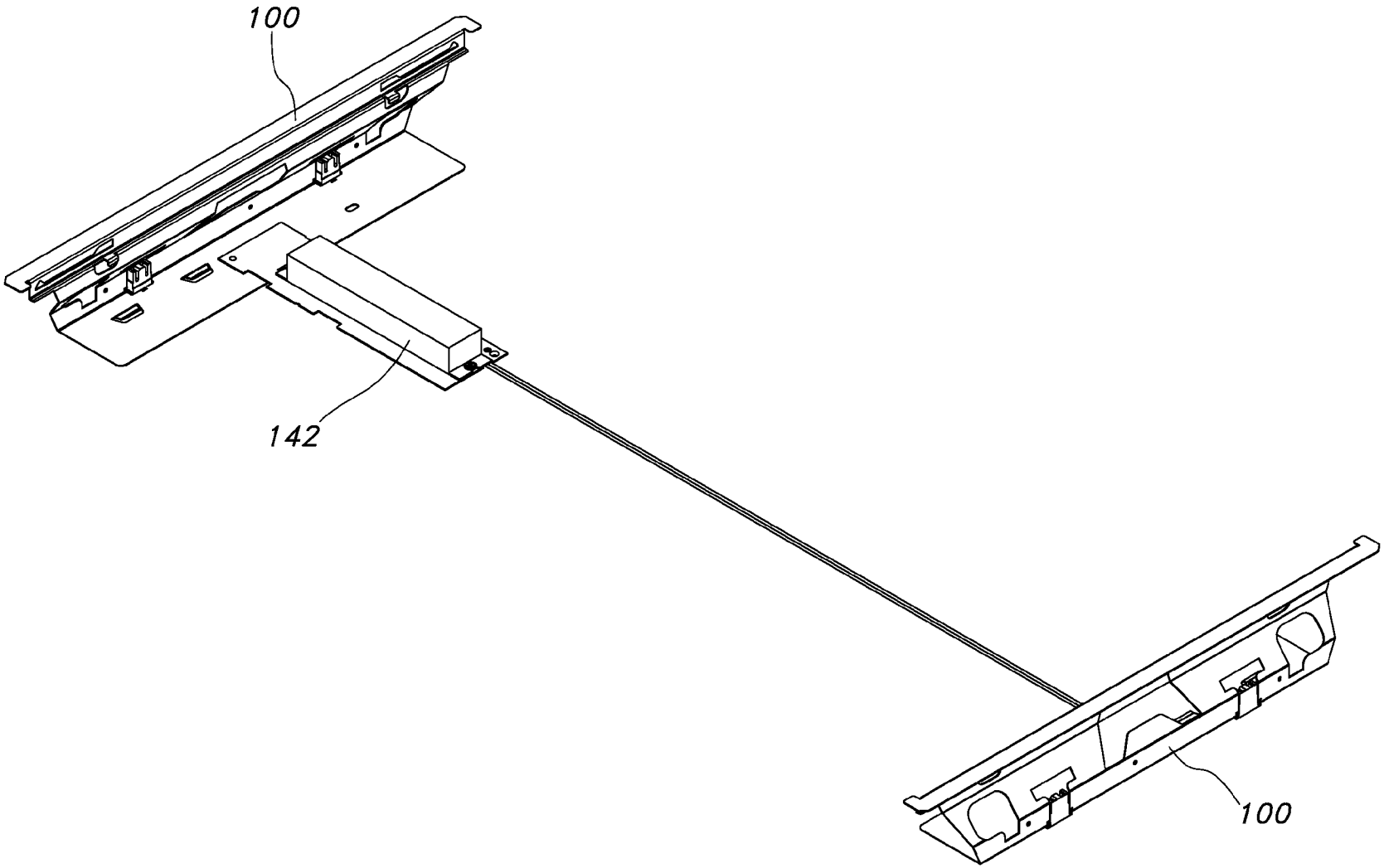

FIG. 11 is a perspective view of a pre-wired set of brackets and ballast according to one embodiment of this invention.

Figure 12:
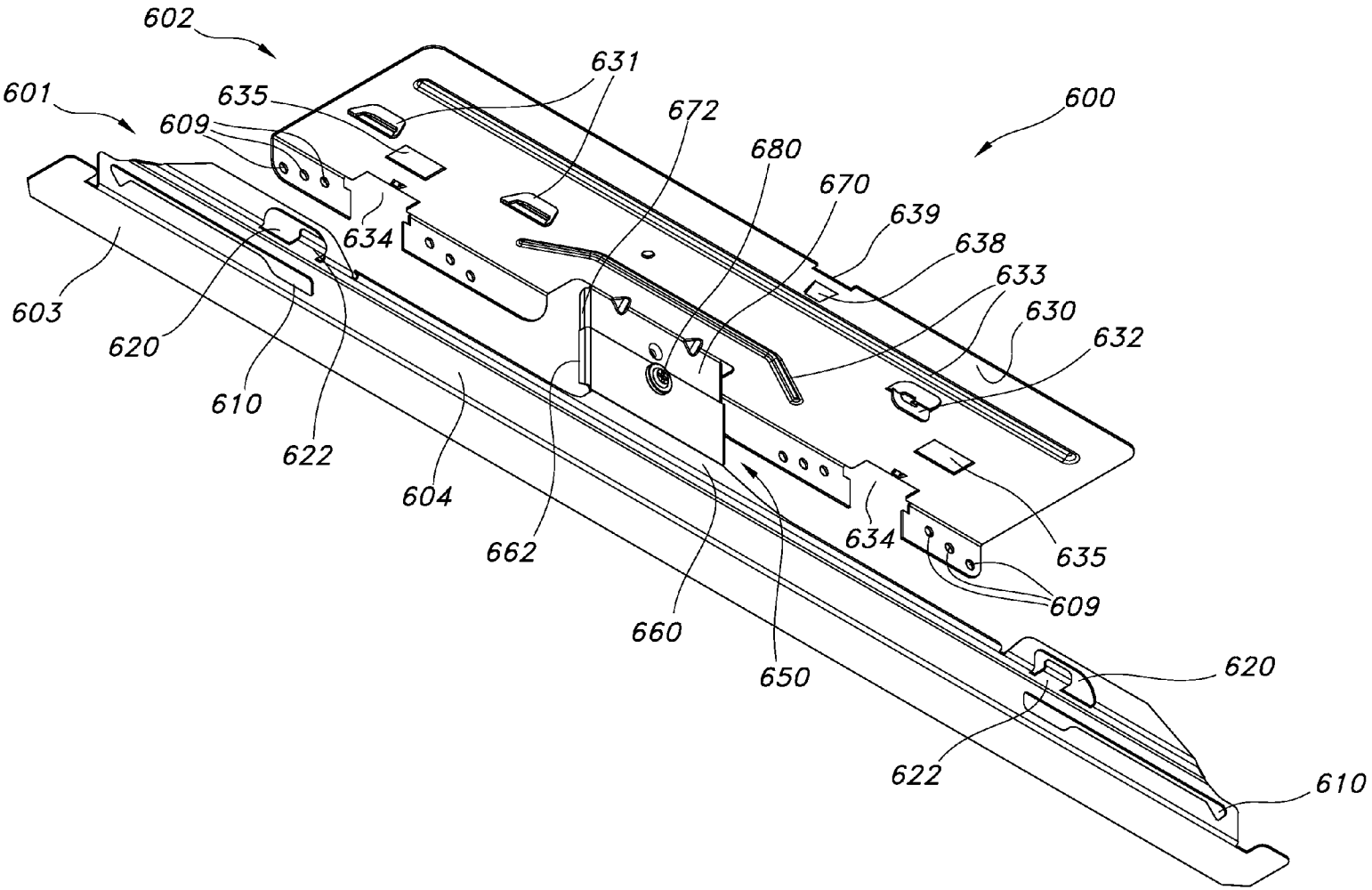

FIG. 12 is a bottom perspective view of an alternative embodiment of a bracket of the retrofit system.

Figure 13:
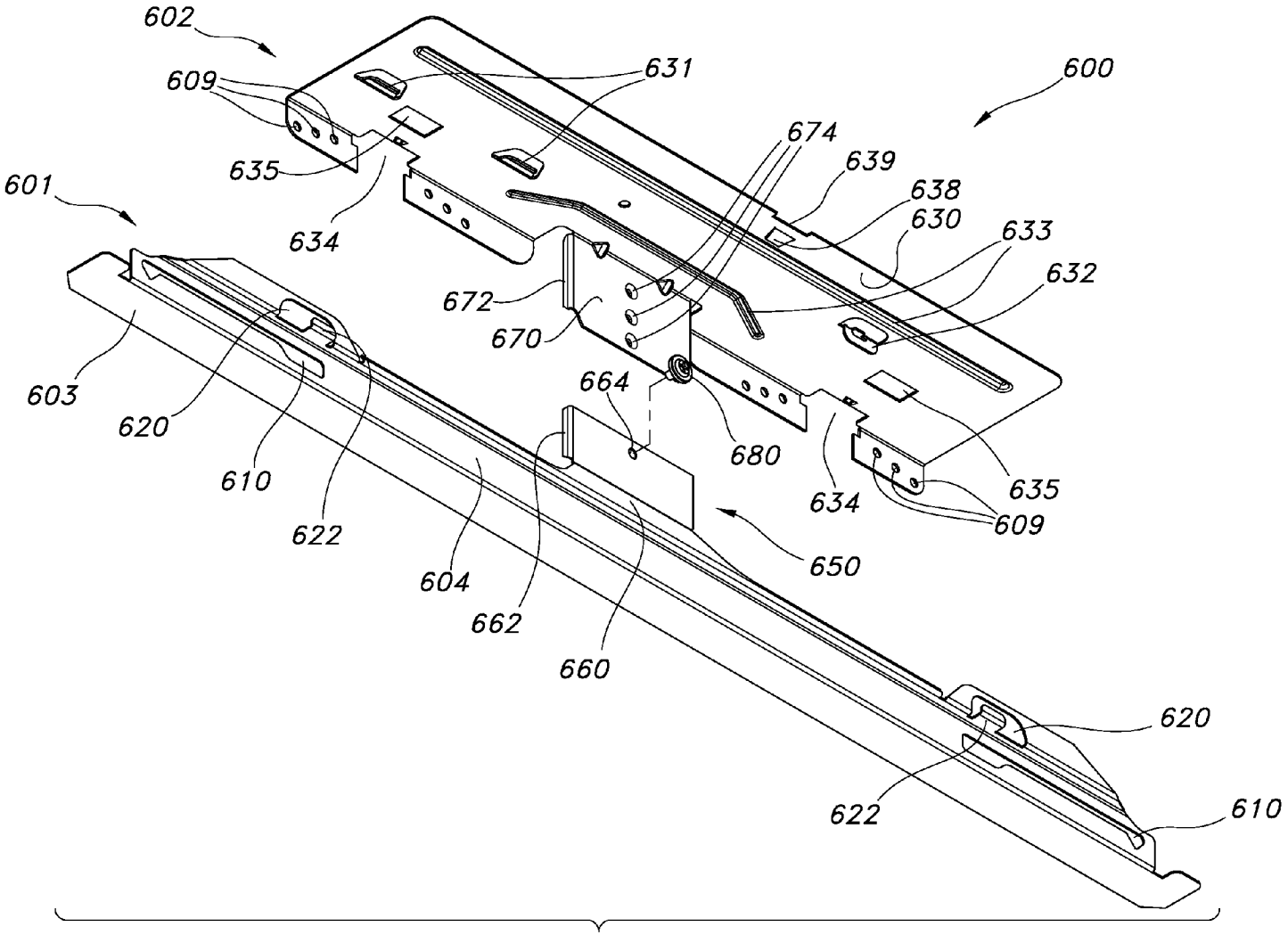

FIG. 13 is an exploded view of the bracket of FIG. 12.

Figure 14:
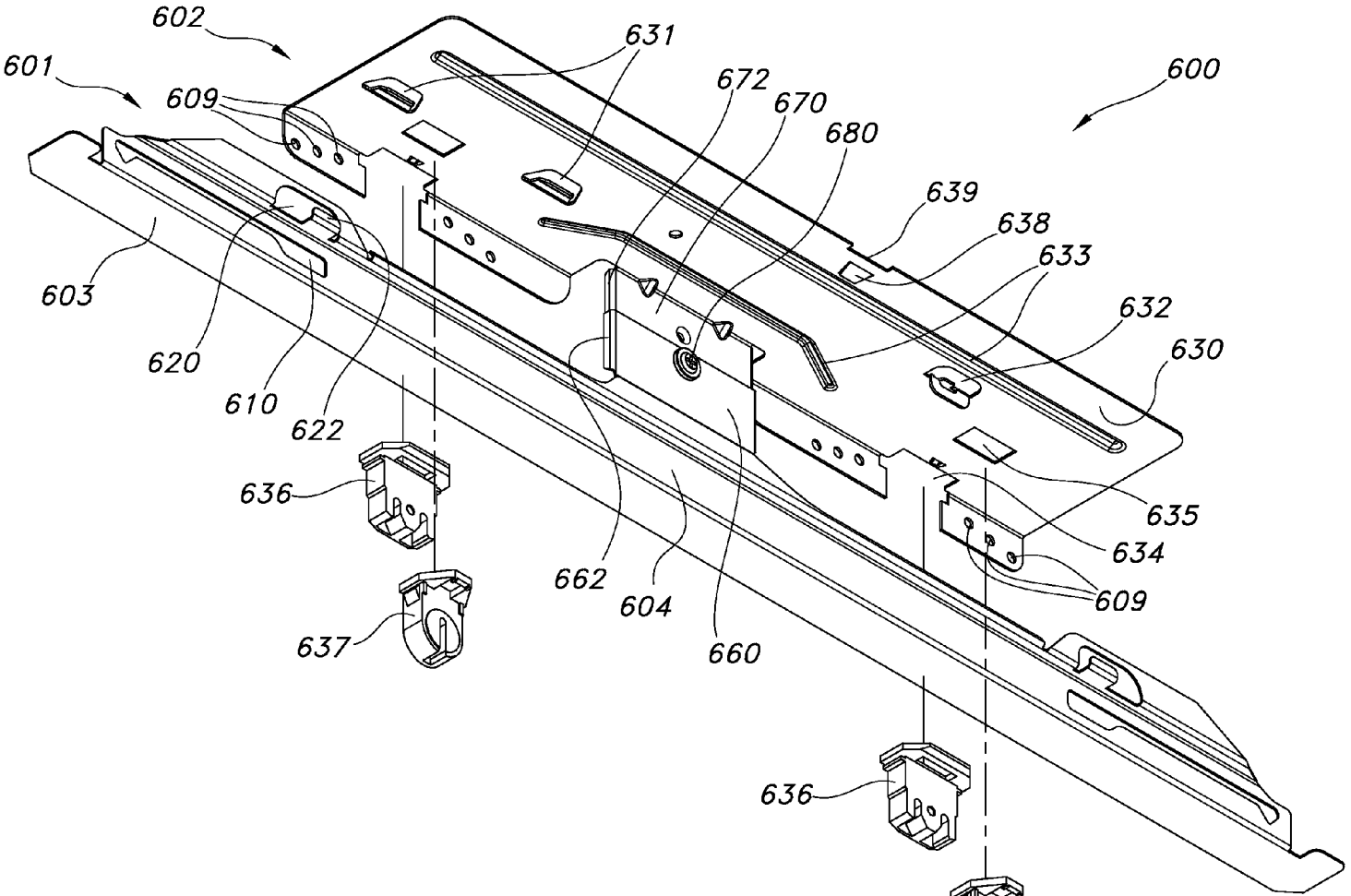

FIG. 14 is another bottom perspective view of the bracket of FIG. 12.

Figure 15:
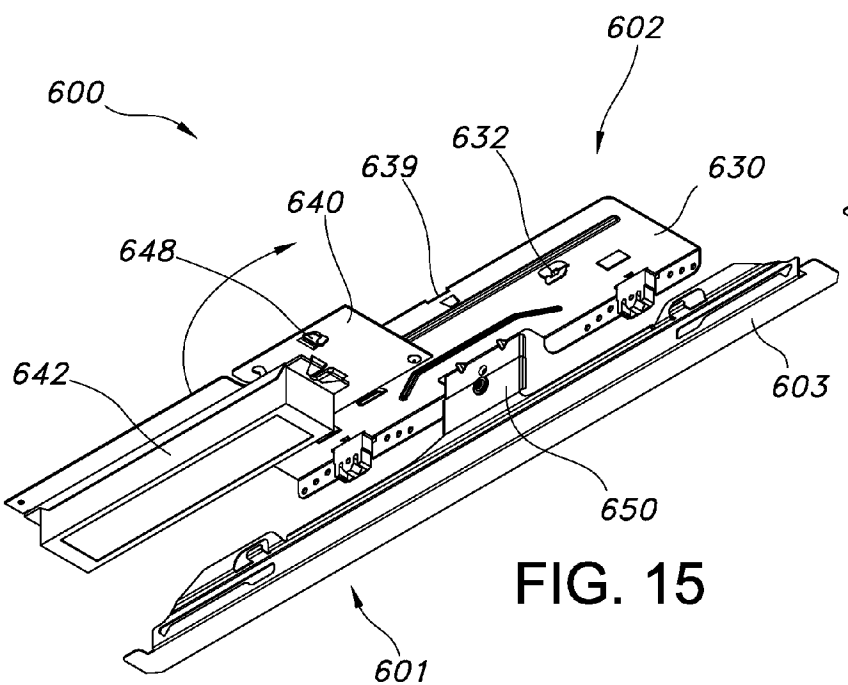

FIG. 15 is a bottom perspective view of the bracket of FIG. 12 and the ballast tray with ballast.

Figure 16:
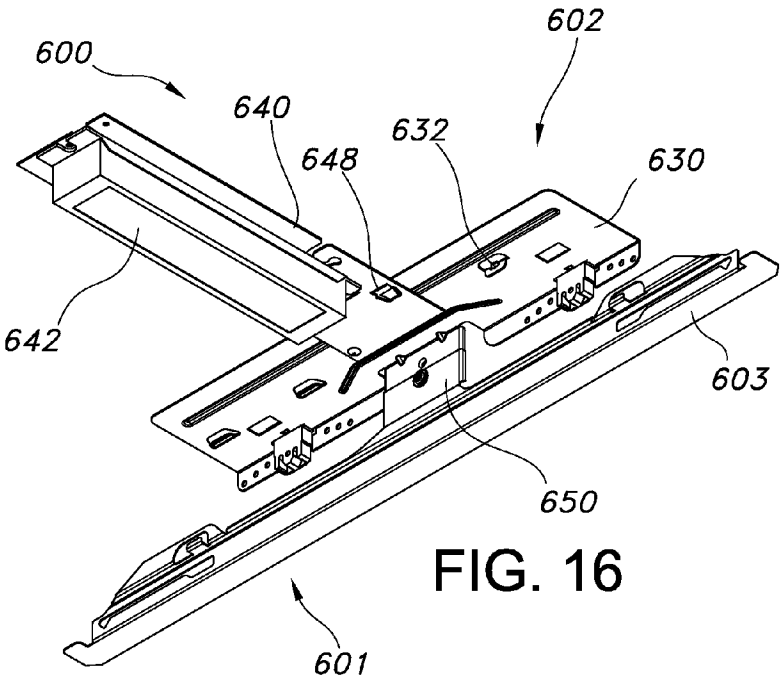

FIG. 16 is another bottom perspective view of the bracket and ballast tray with ballast of FIG. 15.

Figure 17:
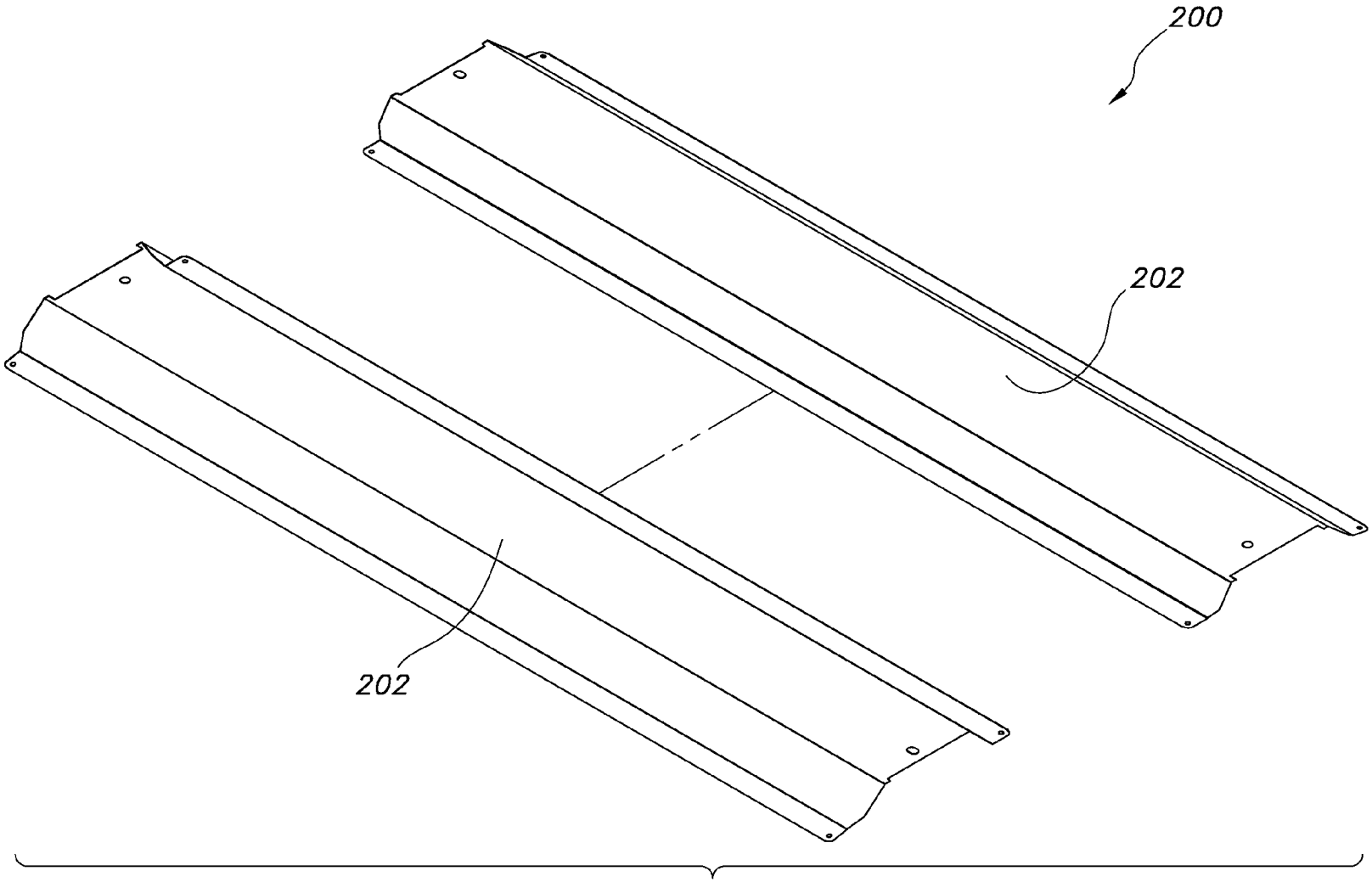

FIG. 17 is a perspective view of two reflectors according to one embodiment of this invention.

Figure 18:
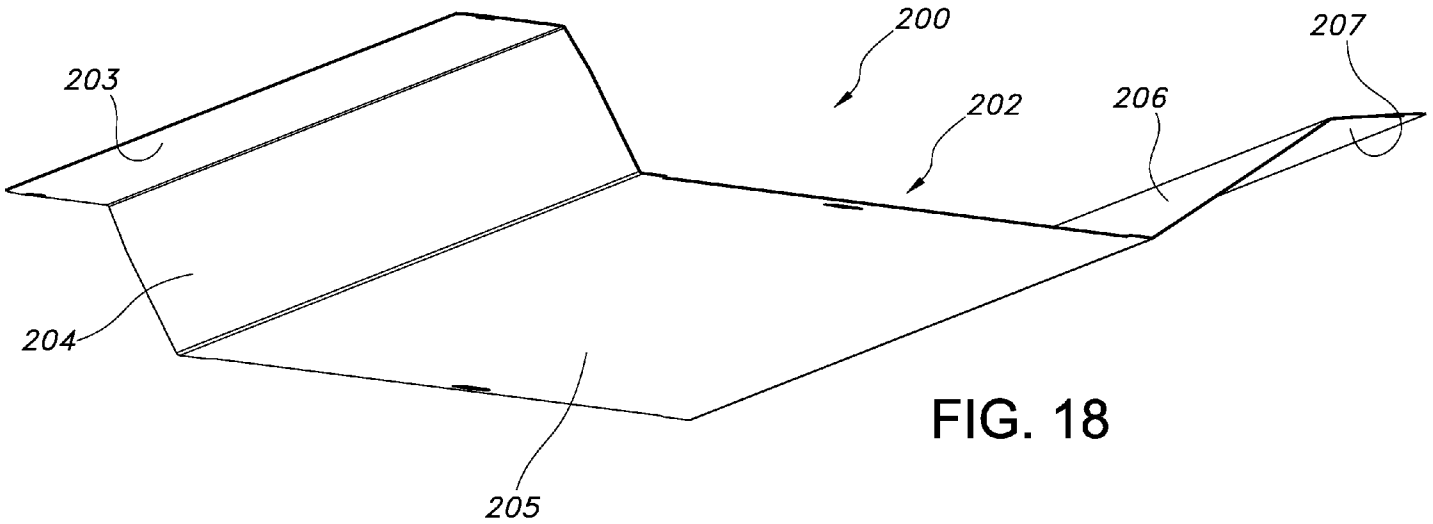

FIG. 18 is a bottom perspective view of one of the reflectors of FIG. 17.

Figure 19:
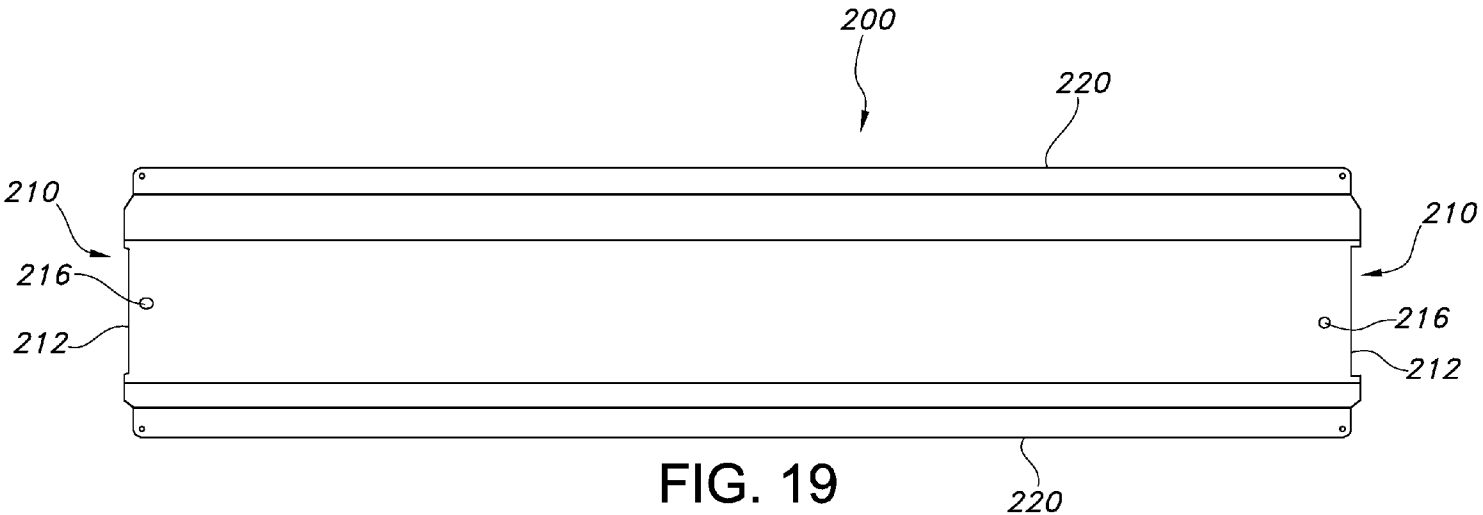

FIG. 19 is top plan view of the reflector of FIG. 18.

Figure 20:
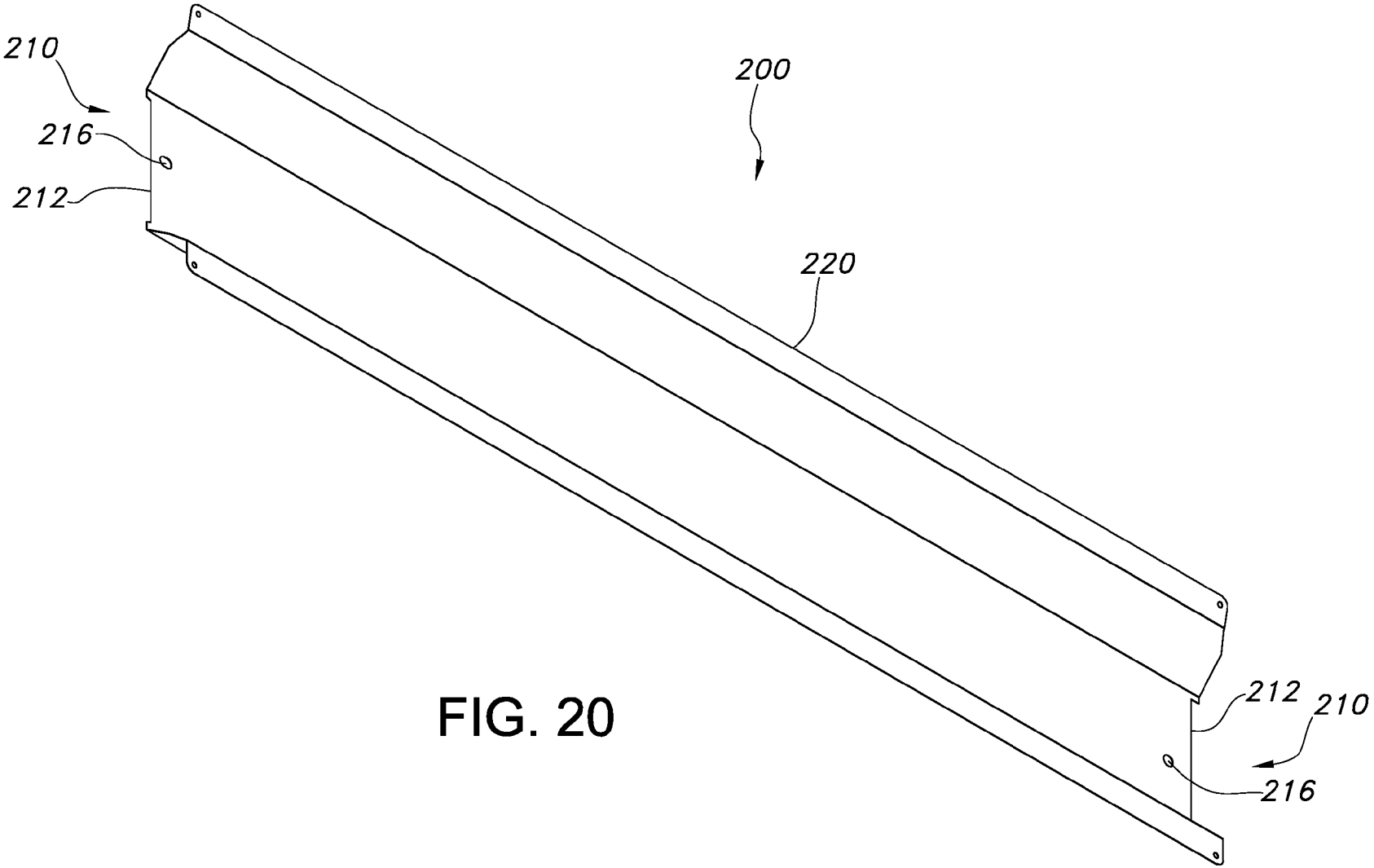

FIG. 20 is another perspective view of one of the reflectors of FIG. 19.

Figure 21:
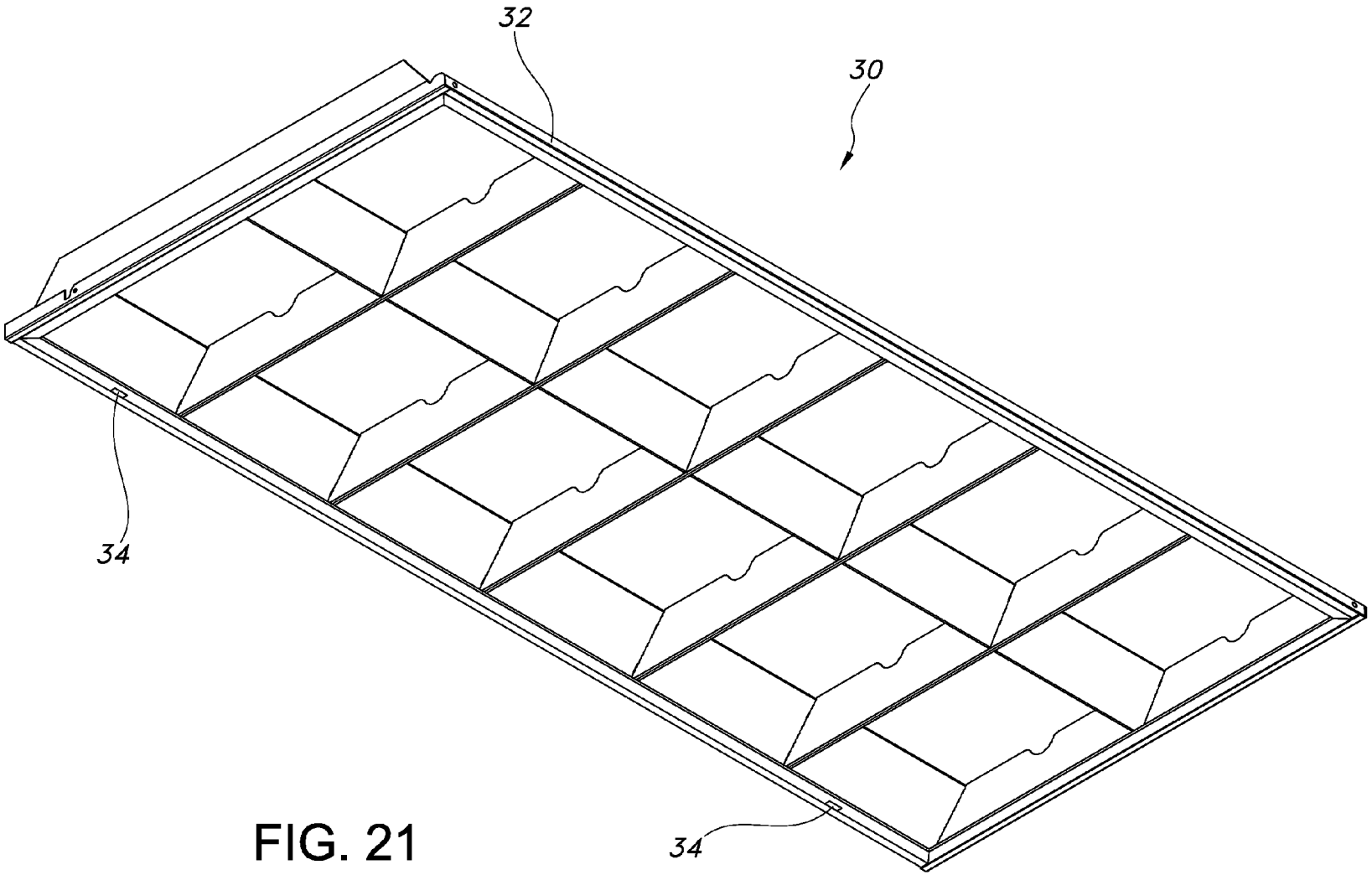
FIG. 21 (Prior Art)

FIG. 21 is a bottom perspective view of a louver assembly within a frame known in the prior art.

Figure 22:
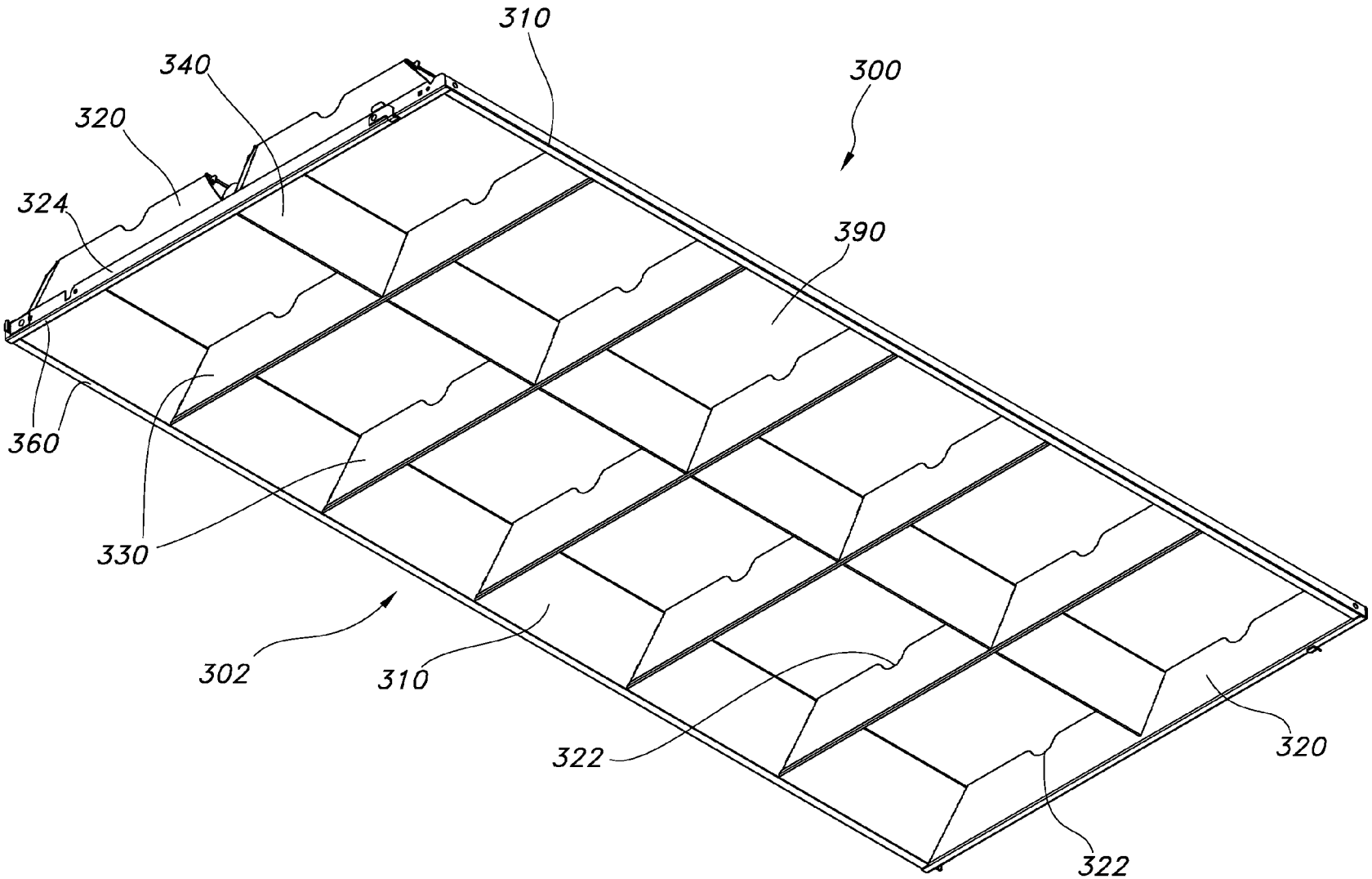

FIG. 22 is a bottom perspective view of a louver assembly according to one embodiment of this invention.

Figure 23:
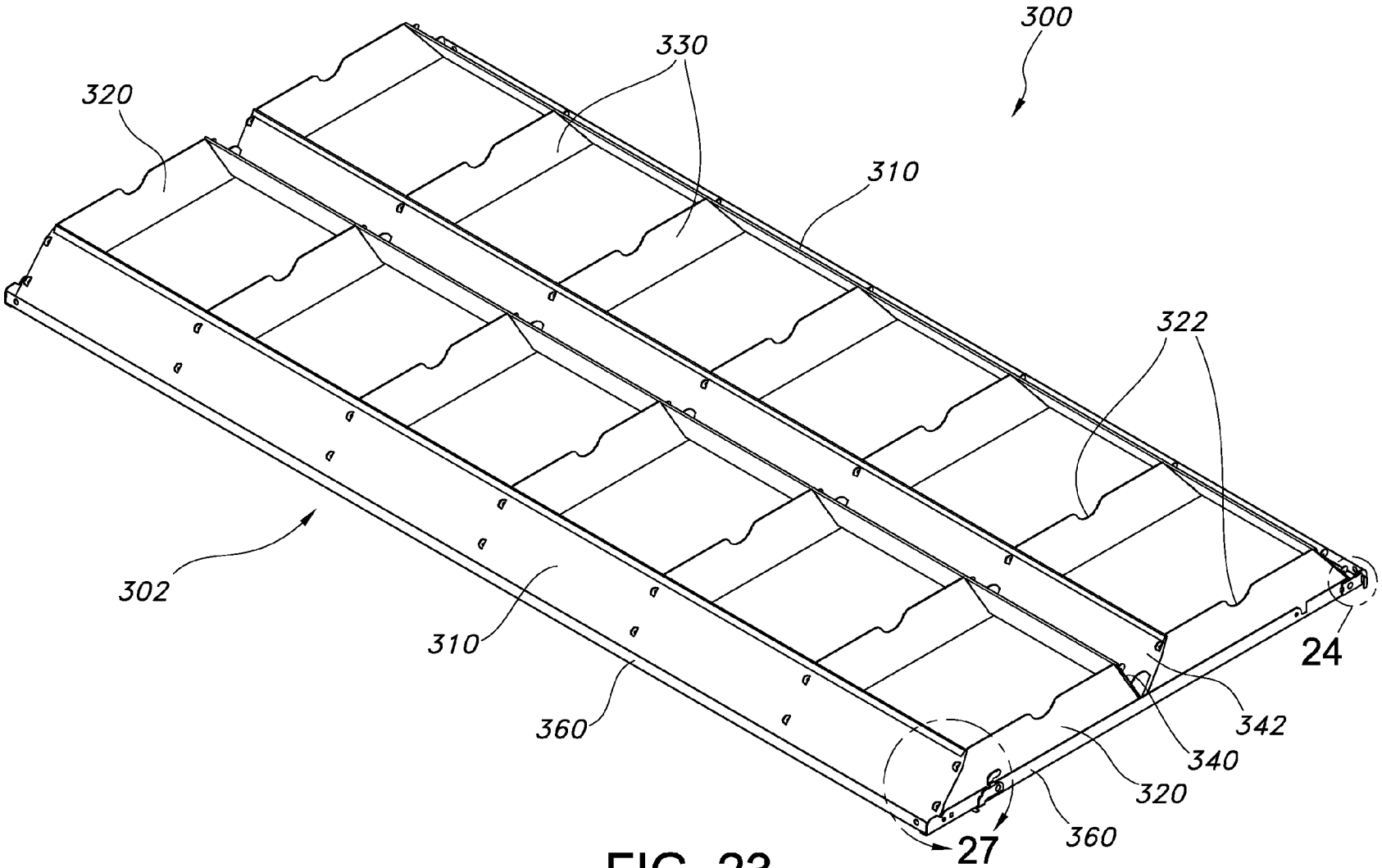

FIG. 23 is a top perspective view the louver assembly of FIG. 22.

Figure 24:
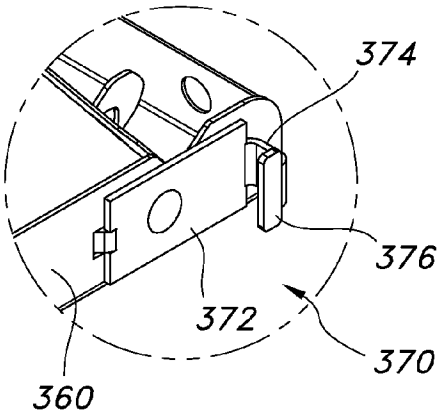

FIG. 24 is an enlarged section taken at insert circle 24 in FIG. 23.

Figure 25:
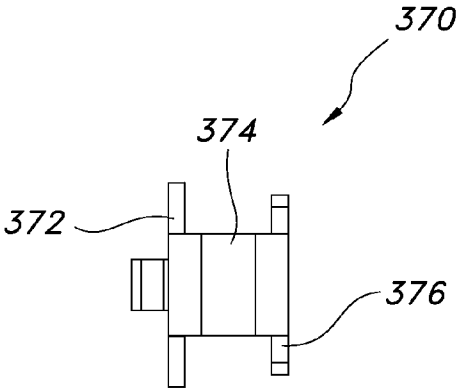

FIG. 25 is a top plan view of a hinge shown in FIG. 24.

Figure 26:
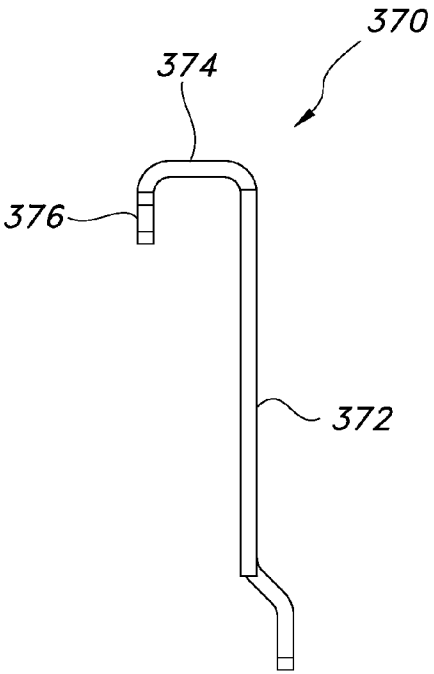

FIG. 26 is a side elevation view of the hinge of FIG. 24.

Figure 27:
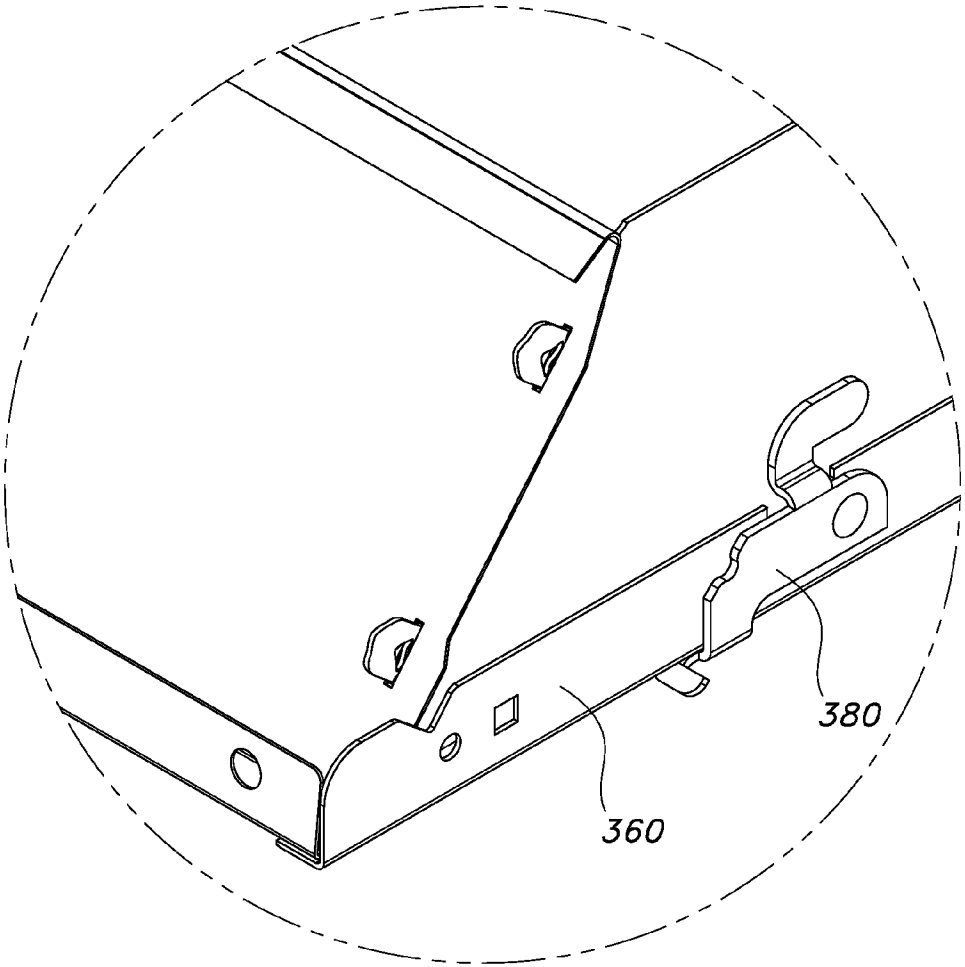

FIG. 27 is an enlarged section taken at insert circle 20 in FIG. 23.

Figure 28:
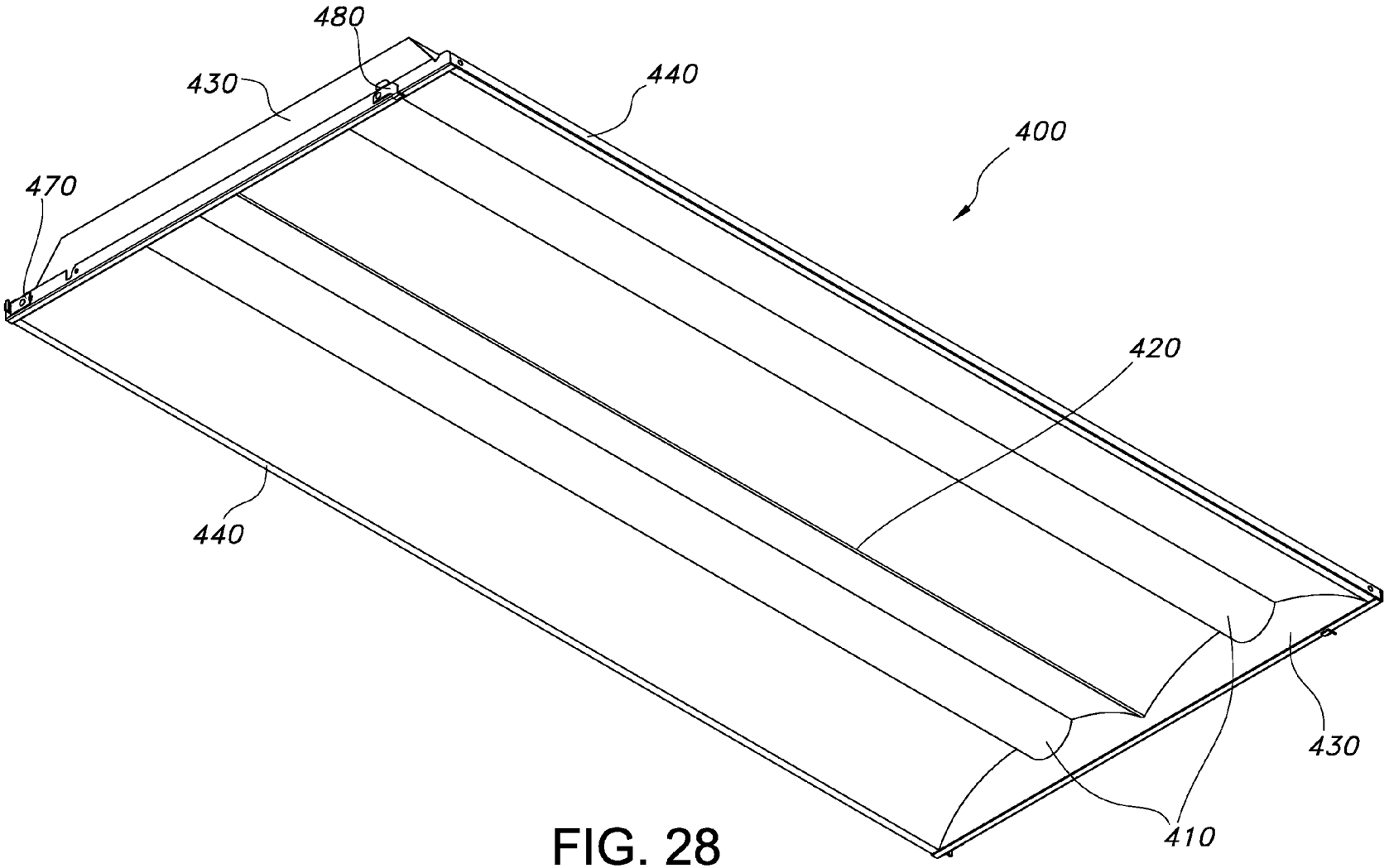

FIG. 28 is a bottom perspective view of a lens assembly according to one embodiment of this invention.

Figure 29:
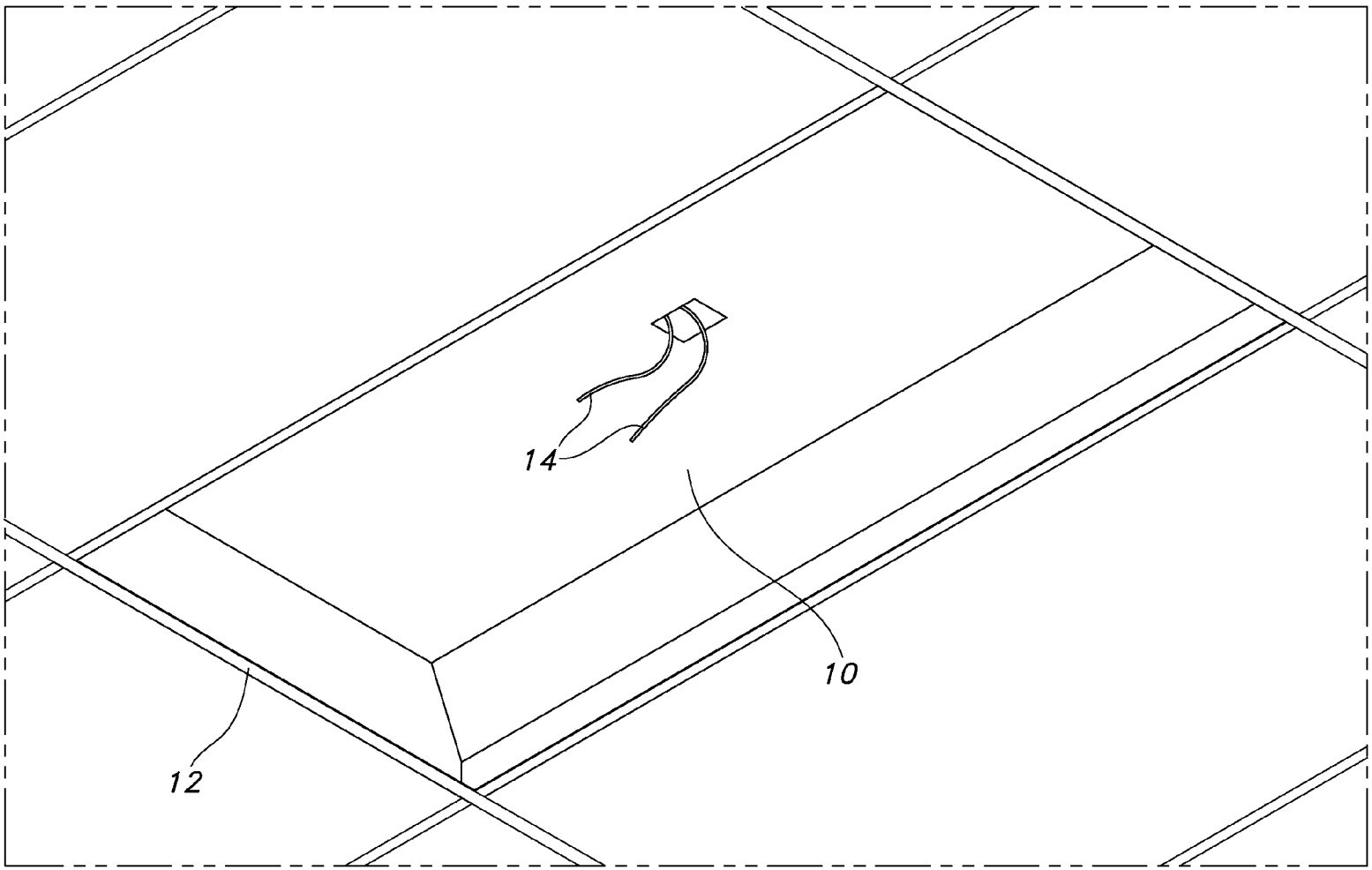

FIG. 29 is a perspective view of a light fixture housing according to one embodiment of this invention.

Figure 30:
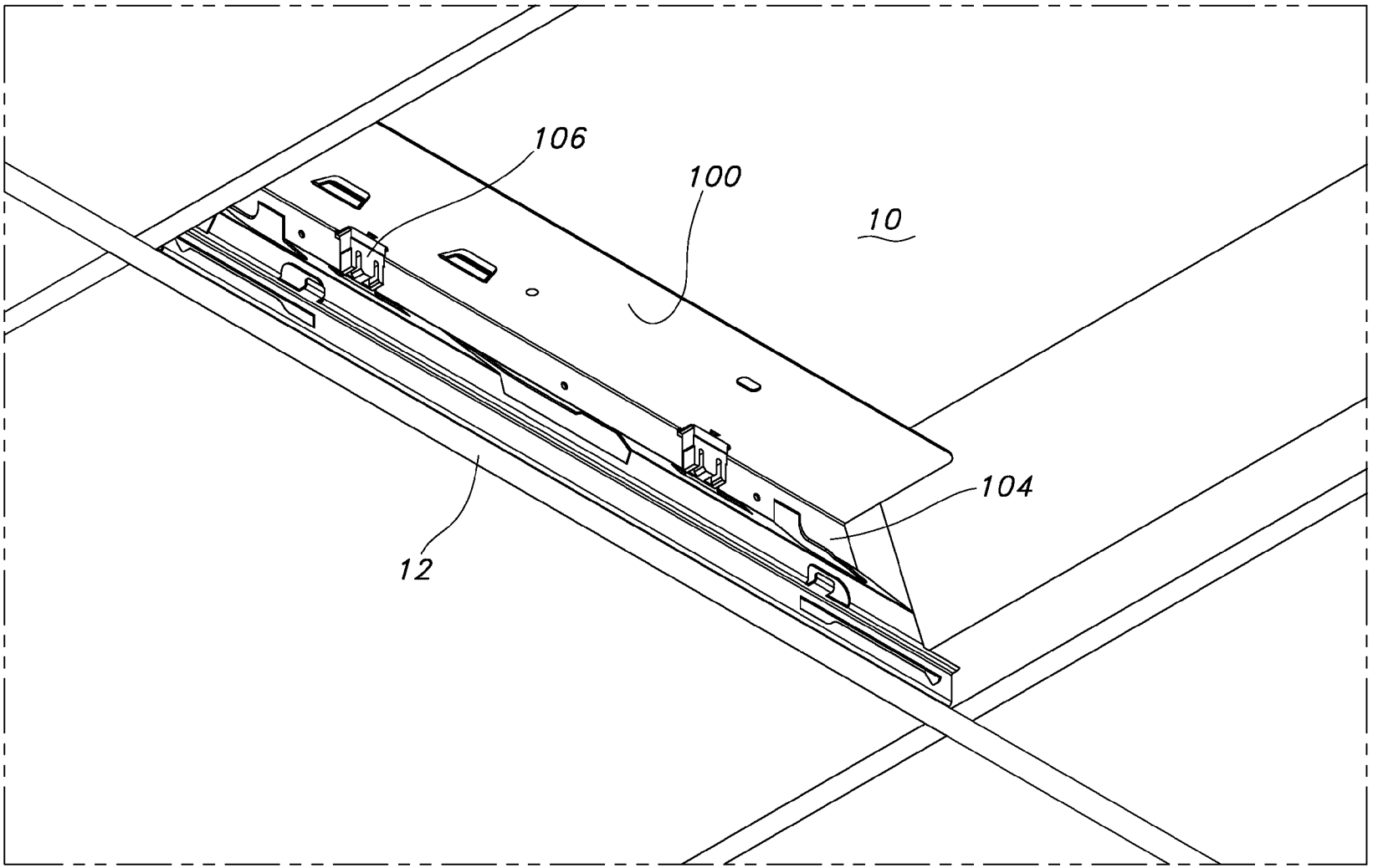

FIG. 30 is a perspective view of a bracket mounted in the housing of FIG. 29.

Figure 31:
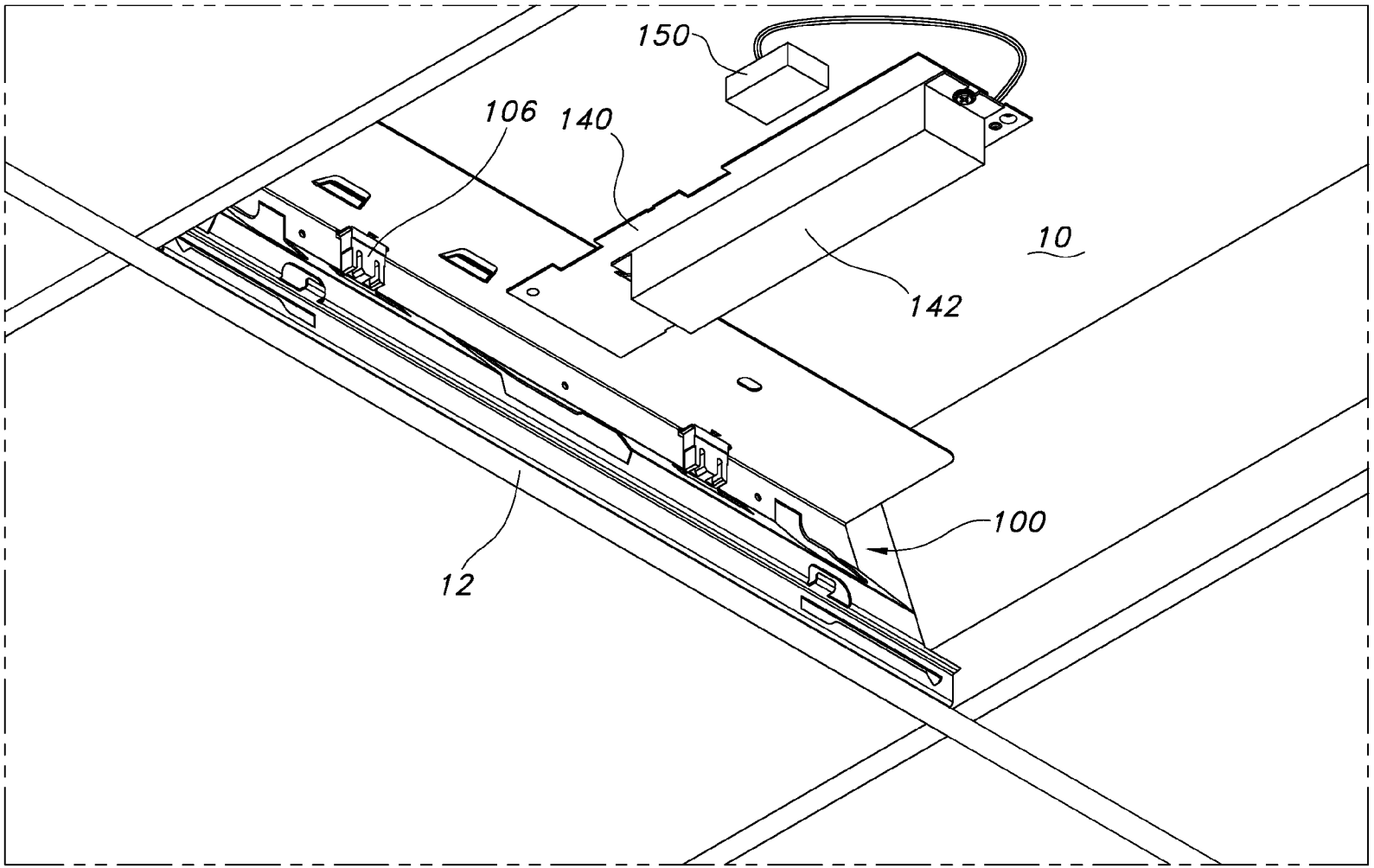

FIG. 31 is a perspective view of a splice box with the housing and bracket of FIG. 30.

Figure 32:
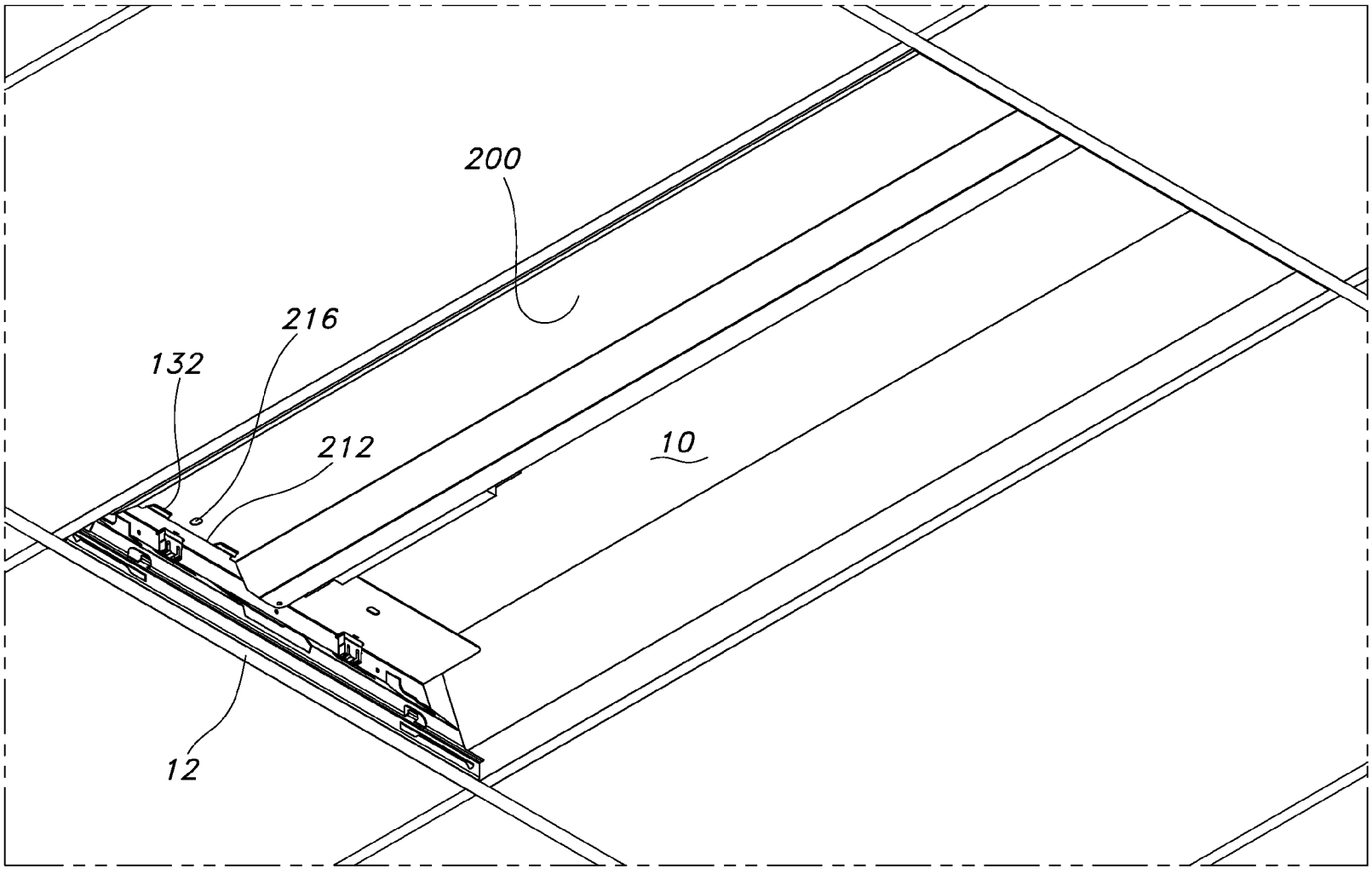

FIG. 32 is a perspective view of a reflector positioned in the bracket and housing of FIG. 30.

Figure 33:
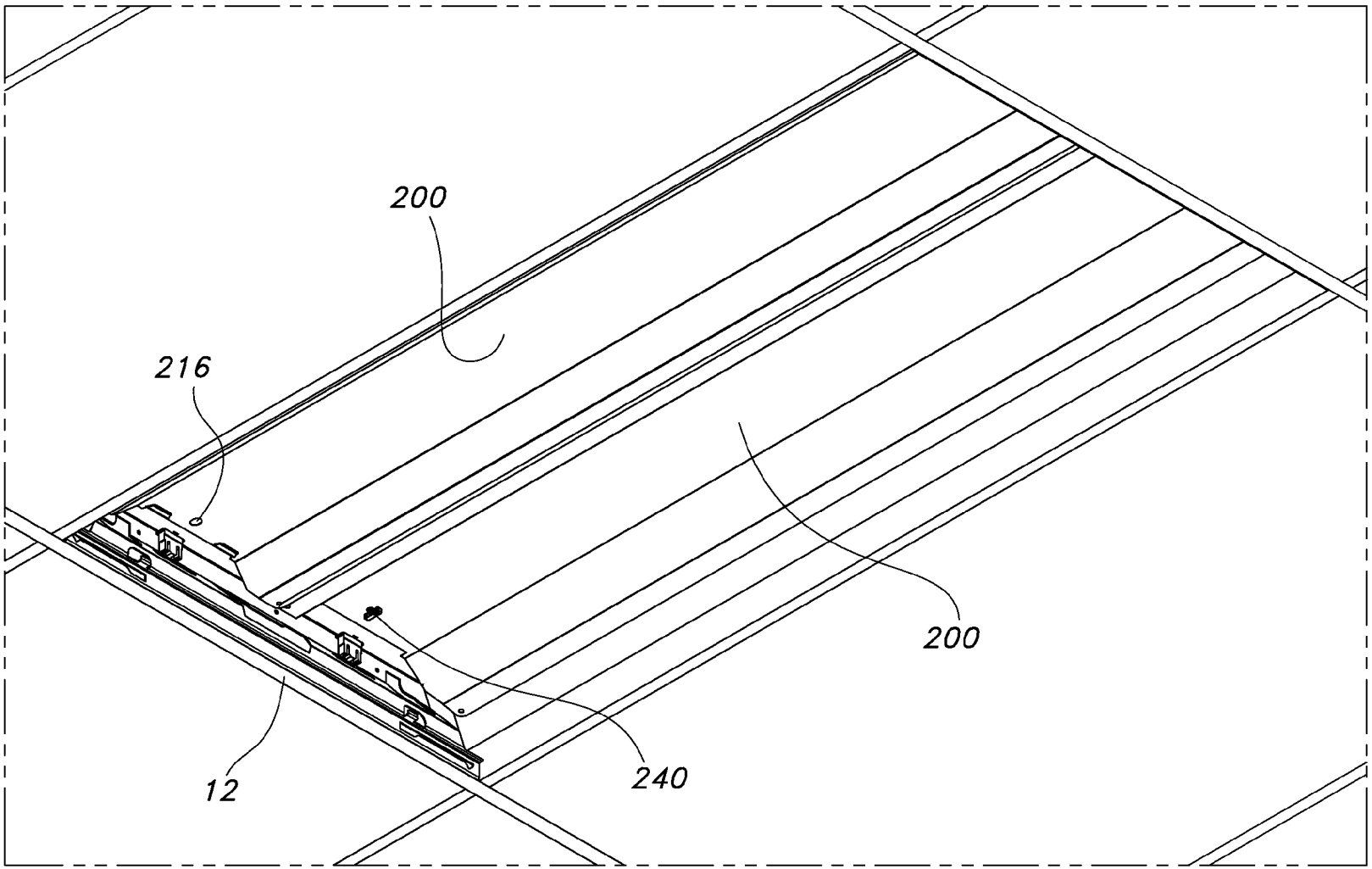

FIG. 33 is a perspective view of two reflectors positioned in the bracket and housing of FIG. 30.

Figure 35:
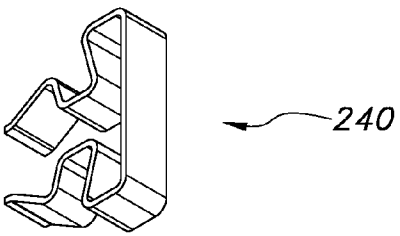
Figure 34:
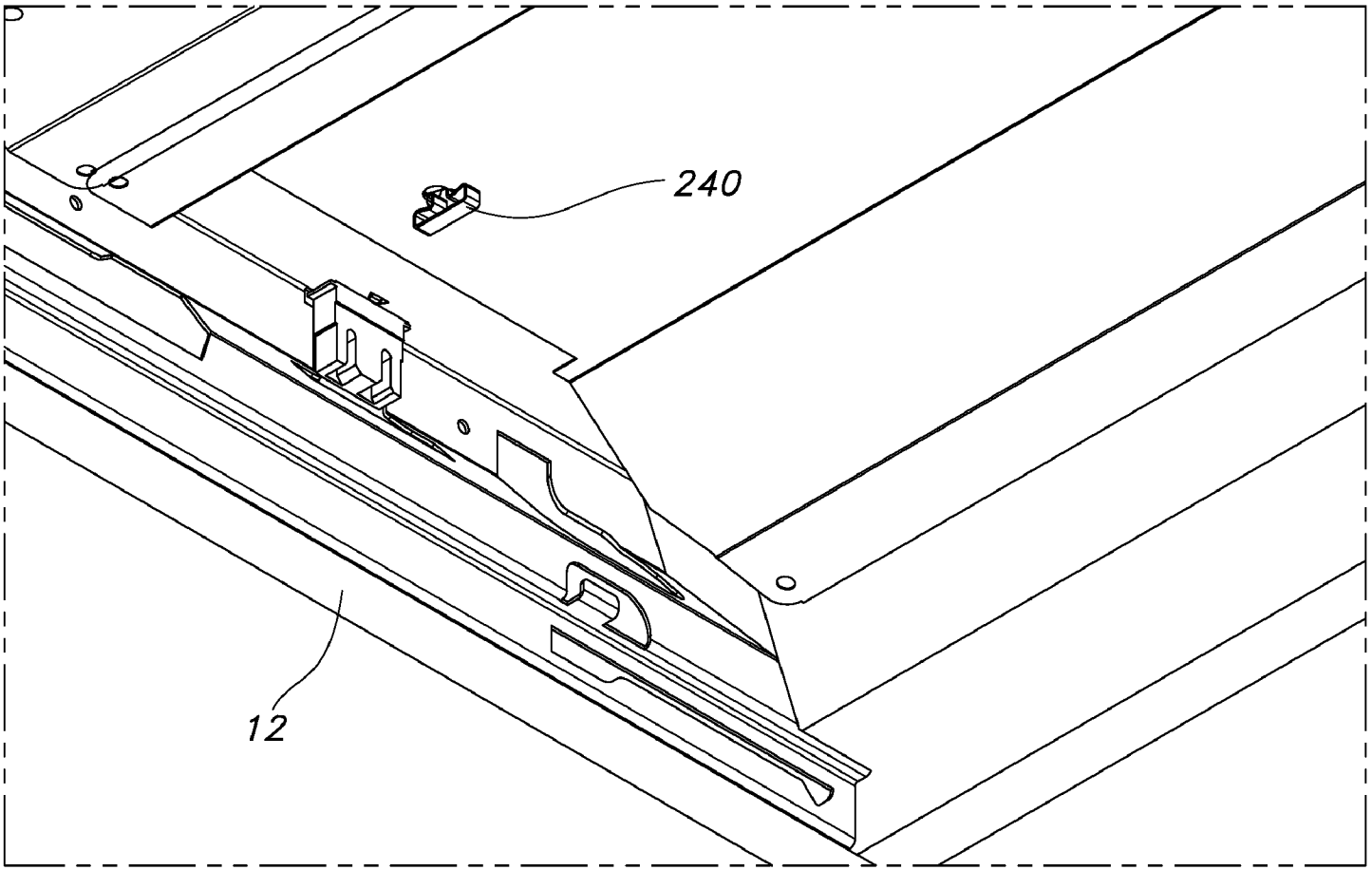

FIG. 34 is a perspective view of one of the reflectors of FIG. 33 secured with a fastener as shown in FIG. 35.

FIG. 35 is a perspective view of a fastener according to one embodiment of this invention.

Figure 36:
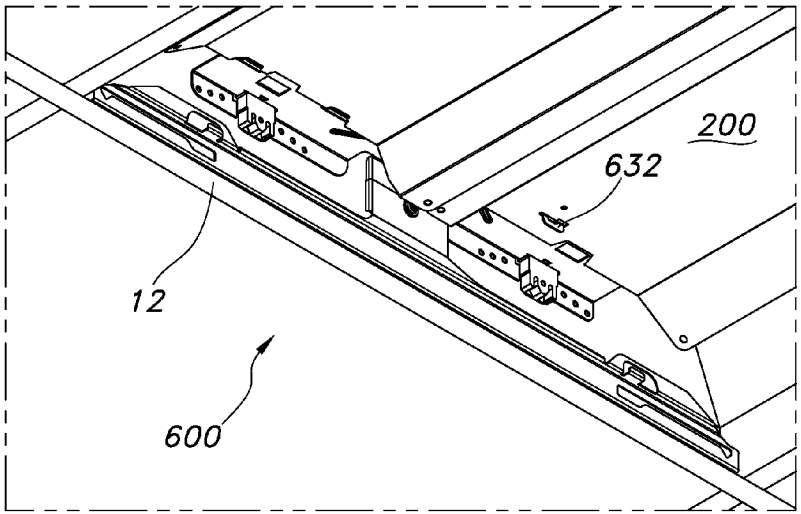
Figure 37:
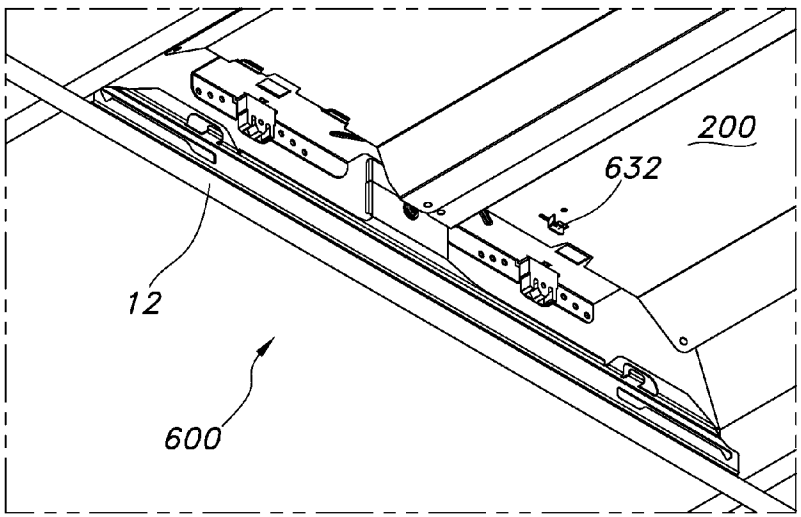

FIGS. 36 and 37 are perspective views of a mounting bracket engaging a reflector of FIG. 33.

FIGS. 38-45 are views illustrating installation of a louver in the housing.

DETAILED DESCRIPTION OF EMBODIMENTS OF THE INVENTION

Figure 1:
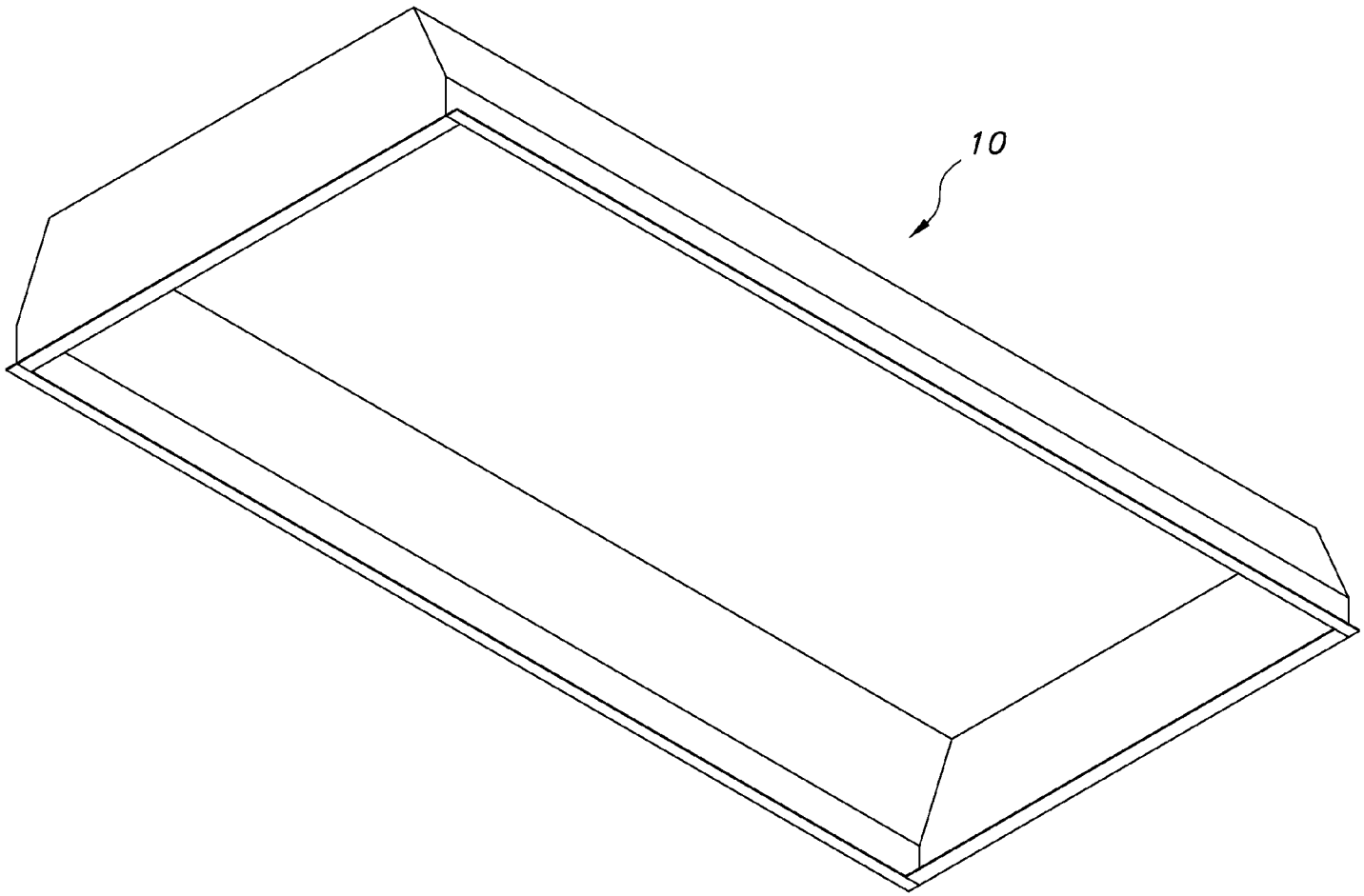
FIG. 1 (Prior Art)
FIG. 1 is a perspective view of a prior art light fixture housing.
Figure 2:
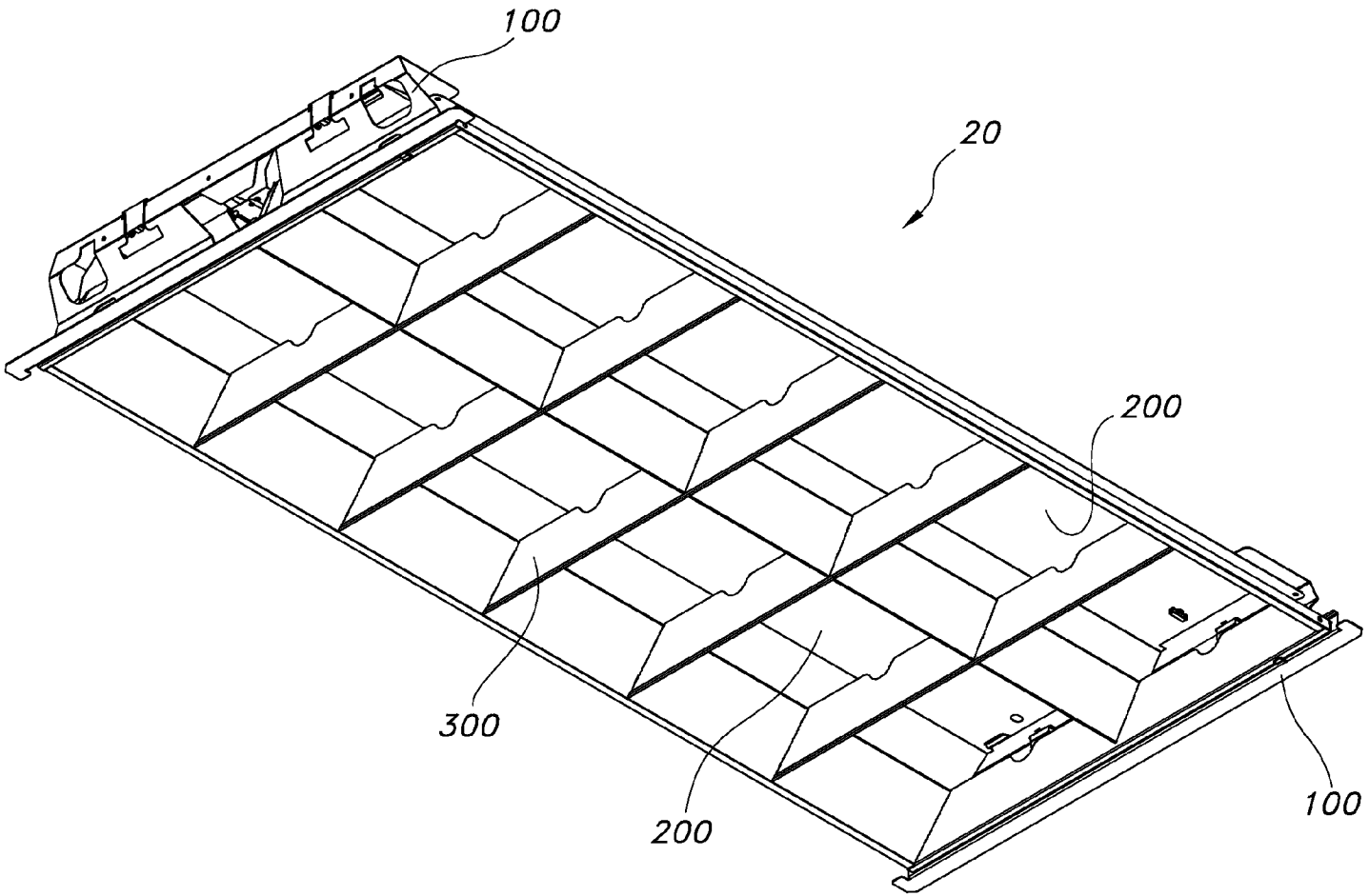
FIG. 2 is a perspective view of a retrofit system according to one embodiment of this invention.
Figure 3:
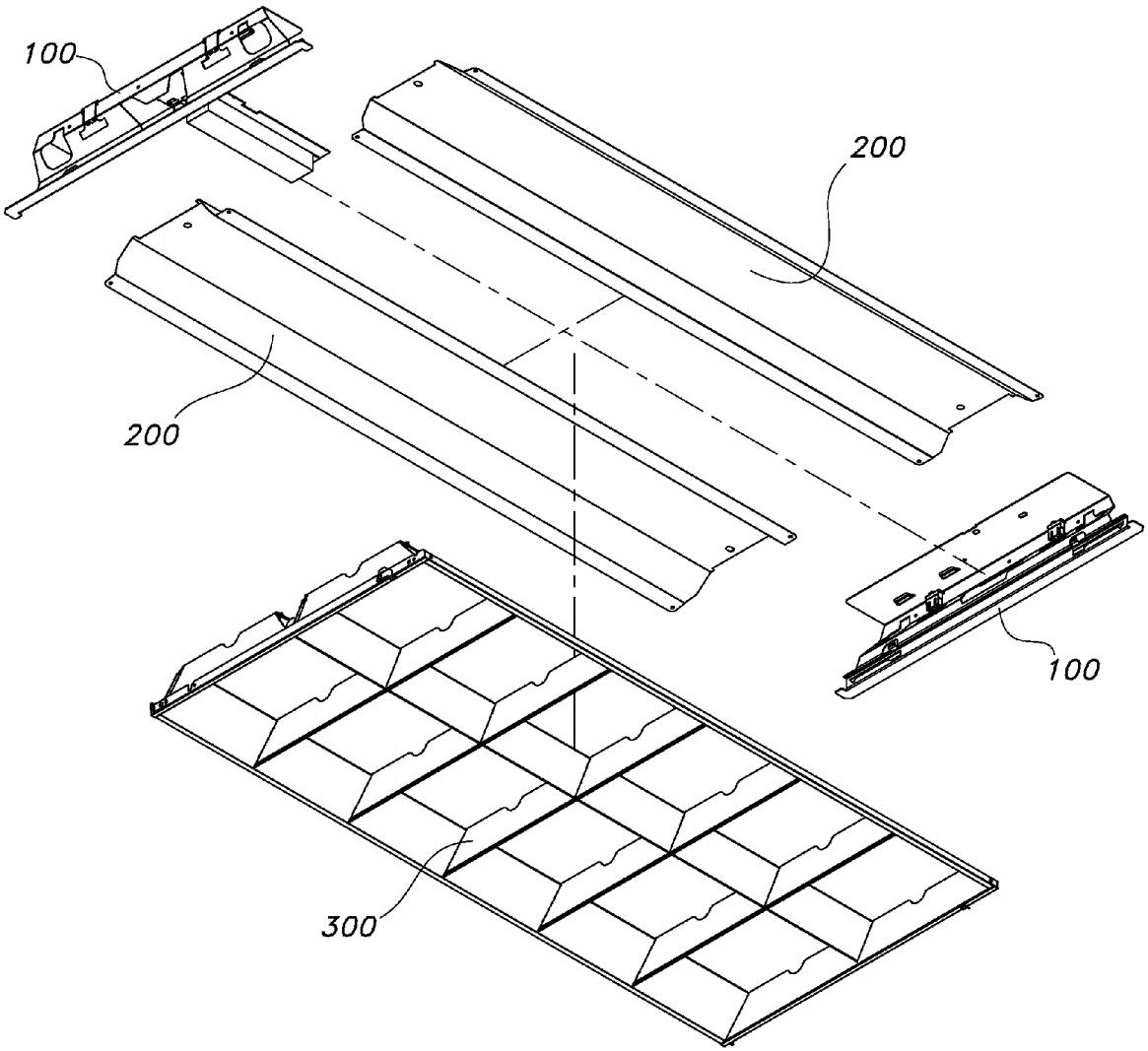
FIG. 3 is an exploded view of the retrofit system of FIG. 2.

Embodiments of this invention provide retrofit systems 20 for replacing the outdated components of an existing light fixture. Such retrofit system 20 allow for replacement of all existing fixture components, including sockets, interior wiring, ballasts, and the like, while retaining the light fixture housing 10 as shown in FIG. 1. Utilizing the previously installed light fixture housing 10 obviates the need to access the potentially hazardous environment above the light fixture housing 10, thereby eliminating the risk of accidental encounters with live wiring as well. Additionally, in the case of recessed light fixtures, installation of the retrofit systems 20 does not require removal of ceiling tiles, t-grids, or other various ceiling components. Thus, potential environmental hazards above the housing are contained.

FIGS. 2-45 illustrate various aspects of one embodiment of a retrofit system 20. The invention is by no means limited to the embodiment illustrated in these Figures. Rather, one of skill in the art will understand that modifications may be made to various aspects of the retrofit system 20 without departing from the spirit and scope of the invention.

The retrofit system 20 is designed to work with a variety of existing light fixture housings. The retrofit system 20 generally includes a pair of mounting brackets 100, reflectors 200, and shielding mechanism such as a louver 300 or lens assembly 400 (all references to the louver 300 throughout this application are equally applicable to the lens assembly 400, unless otherwise indicated). The components of the retrofit system 20 are described in detail below, as well as their interaction during installation.

Mounting Brackets

FIGS. 4-11 illustrate a mounting bracket 100 of the retrofit system 20 according to one embodiment of this invention. The retrofit system 20 of FIGS. 2 and 3 may use two mounting brackets 100, one for each end of the housing 10. However, in other embodiments, the number of brackets used, as well as the bracket placement, may vary depending on the constraints of the existing light fixture housing 10 and the desired distribution and mixture of light.

The structure of one mounting bracket 100 is described. It is preferable, but not required, that the structure of the second mounting bracket 100 provided in the retrofit system 20 be identical, decreasing manufacturing costs. The mounting bracket 100 includes a bottom flange 102, which may partially, intermittently, or fully run the length of the bottom edge of the bracket 100. The bottom flange 102, oriented in a horizontal plane, is used to align the bracket 100 along the bottom edge of the light fixture housing 10. This alignment procedure will be discussed in further detail below.

Figure 5:
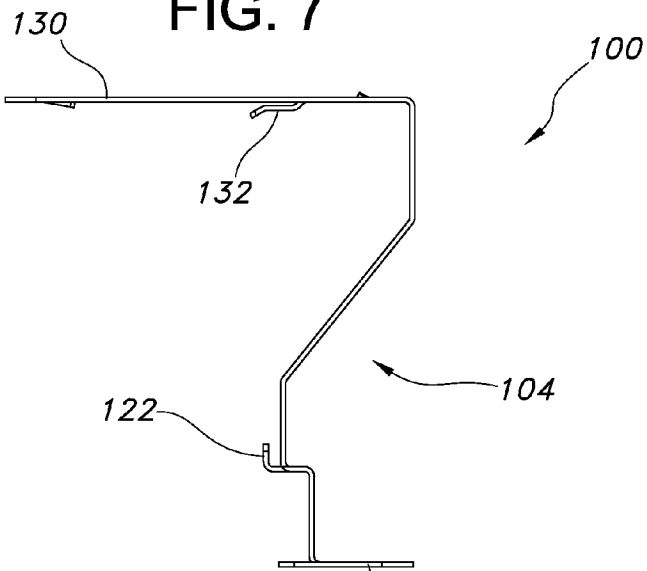
FIG. 5 is a side elevation view of the bracket of FIG. 4.

The bottom flange 102 is connected to a vertical portion 104 of the bracket 100. As shown in FIGS. 4-6, the vertical portion 104 of the bracket 100 may be formed of different planar components. The shape formed by the vertical portion 104 avoids interference with the end plates, or bottom portions, of the light fixture housing, which can vary from housing to housing. In other embodiments, the vertical portion 104 may form various other shapes to assist with the bracket's fit with the light fixture housing 10. The vertical portion 104 includes lamp apertures 105 in which lamp sockets 106, as shown in FIGS. 9-10, may be housed. As shown in FIGS. 4, 6 and 7, each bracket 100 has two apertures 105 for two lamp sockets 106. However, in other embodiments of this invention, the number of apertures 105 and lamp sockets 106 may vary. In other embodiments, lamp sockets 106 may be mounted directly onto a surface of a mounting bracket 100. The vertical portion 104 may also include outer installation apertures 107 and inner installation apertures 108. The apertures 107 and 108 assist in the installation of lamps once the retrofit system 20 has been installed, which will be discussed in detail below. Securing apertures 109 may be positioned along the vertical portion 104 of the bracket 100. The securing apertures 109 may receive fasteners to be secured to the housing 10.

Figure 6A:
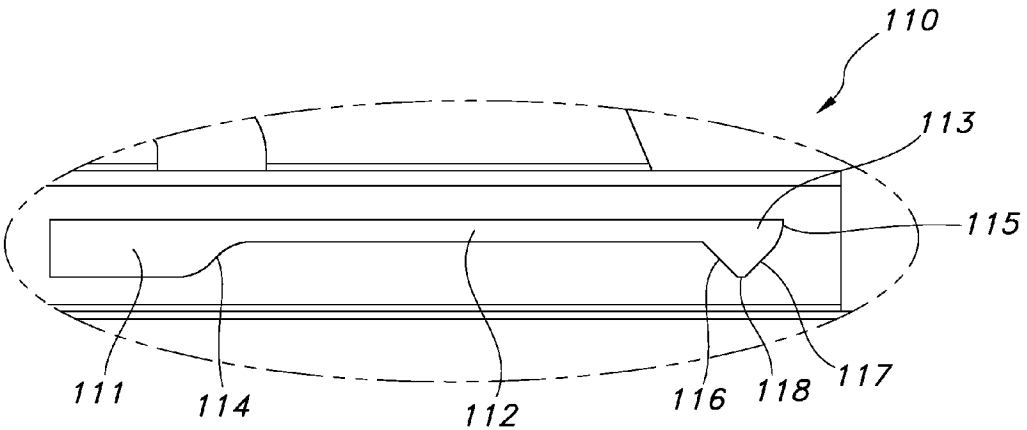

At least one mounting aperture or slot 110 (hereinafter "slot") is located on the vertical portion 104 of at least one bracket 100 and is configured to receive a hinge of the louver 300, as is discussed in more detail below. As illustrated in FIG. 6A, the slot 110 may be divided into three sections: an insertion section 111, an advancement section 112, and a retention section 113. In this embodiment, a sloped edge 114 connects the insertion section 111 to the advancement section 112. The retention section 113 has an outside edge 115, and two sloping edges 116 and 117 that meet together to form a vertex 118 at the retention section's 113 bottom portion. The slot 110 need not have this precise structure, however. As will be discussed below in more detail, the structure of the slot 110 facilitates installation of the louver 300, and more specifically retention of the louver's hinges, and thus any slot configuration that performs this function is contemplated herein. In some embodiments of this invention, the bracket 100 may include a notch instead of a slot 110 along the vertical portion 104. The notch is configured to receive a hinge of the louver 300, similar to the slot. While the notch does not have apertures or openings like the slot, the notch may include insertion, advancement, and retention sections similar to those of the slot.

Preferably, but not necessarily, two slots 110 are provided on the bracket 100. More preferably, but not necessarily, the two slots 110 are mirror images of one another. Such a configuration enhances the versatility of the retrofit system 20 during installation. More specifically, by providing two slots 110, the louver 300 can be introduced in a slot 110 on the bracket 100 from either side of the housing 10, depending on which approach is more convenient for the installer given the location and positioning of the housing 10.

As shown in FIG. 4, an aperture 120 surrounding a securing tab 122 is provided on the bracket 100. As discussed in more detail below, the louver 300 is provided with securing means designed to engage the securing tab 122 and thereby help retain the louver 300 on the bracket 100 once the louver 300 has been installed and placed in its final position. For example, cams (discussed below) associated with the louver 300 may engage the securing tabs 122 of the brackets 100. In other embodiments, however, the apertures 120 may be configured to engage a cam or securing means themselves. In addition, other securing means whereby the louver 300 is mechanically interlocked with and retained in position relative to the bracket 100 are contemplated, including, but not limited to, pins, fasteners, and Velcro. Moreover, any number of apertures 120/securing tabs 122 may be provided on bracket 100. As with the slots 110, provision of an aperture 120/securing tab 122 on each side of the bracket 100 renders the retrofit system 20 more versatile during installation, but is not required.

As shown in FIGS. 4-7, an upper flange 130 is connected to the upper end of the vertical portion 104 of the mounting bracket 100. The upper flange 130 extends in the opposite direction as that of the bottom flange 102, extending into the cavity of a light fixture housing 10 when mounted. Tabs 132 used for securing reflectors 200 may extend from the bottom surface of the upper flange 130. As shown in FIG. 4, two tabs 132 may be grouped together on one side of the upper flange 130, with a fastener aperture 134 found opposite the tabs 132. The same arrangement is found on the other bracket 100 of this embodiment of the invention. However, in other embodiments, the tabs 132, and the fastener aperture 134, may be arranged separately or in different groupings and numbers along the upper flange 130, depending on the shape and number of the reflectors used by the retrofit system.

A ballast tray 140 for supporting a ballast 142 may be mounted on a bracket 100. In one embodiment, the ballast tray 140 is mounted on the upper flange 130 of a bracket 100. The ballast tray 140 may be mounted by any means that can support the ballast tray 140 with an associated ballast 142 mounted thereon. The ballast tray 140 is preferably, but not necessarily, mounted so as to be pivotable. In one embodiment, a fastener (not shown) is received in a ballast tray aperture 144 (as shown in FIGS. 8-10). Other mechanical retention devices may be used to secure ballast tray 140 to bracket 100. By pivotally associating the ballast tray 140 with the mounting bracket 100, the ballast tray 140 can be shipped attached to the bracket 100 and positioned underneath or above the upper flange 130 to reduce the shipping footprint of the retrofit system 20, as shown in FIG. 10. An edge of the ballast tray 140 may fit within tabs 132 to help retain the ballast tray 140 in this stored position during shipping. The ballast tray 140 may then be pivoted to extend from the mounting bracket 100 during installation, as shown in FIGS. 8 and 9. Additional structure may be provided to ensure that the ballast tray 140 remains extended from the mounting bracket 100. In one embodiment, a locking tab 148 extends from the ballast tray 140 and engages via a snap-fit connection an indentation 136 and aperture 138 on the upper flange 130.

The ballast tray 140 includes a ballast 142 attached to its lower surface. Inclusion of a ballast tray 140 with associated ballast 142 significantly reduces installation time, as the ballast 142 need not be separately attached as required when replacing existing fixtures. Moreover, the ballast 142 may be pre-wired to the lamp sockets 106 mounted on the brackets 100 prior to installation of the retrofit system 20, as shown in FIG. 11. The ballast tray 140 may include a wire slot 146 or other wire routing guide to prevent the wiring from becoming tangled or damaged during shipping and installation. In other embodiments of this invention, a ballast tray 140 may not be included. In such embodiments, the ballast 142 may be mounted directly to various components of the retrofit system 20 and the light fixture housing 10.

In one embodiment of this invention, the brackets may have an adjustable height. As shown in FIGS. 12-16, a bracket 600 has a lower portion 601 and an upper portion 602. The lower portion 601 of the bracket includes a bottom flange 603, which may partially, intermittently, or fully run the length of the bottom edge of the bracket 600. The bottom flange 603, oriented in a horizontal plane, is used to align the bracket 600 along the bottom edge of the light fixture housing 10.

A vertical portion 604 extends upward from the flange 602 of the lower portion 601 of the bracket 600. The vertical portion 604 includes at least one elongated slot 610, and preferably one on each side of the bracket, configured to receive a hinge of the louver 300. The slot 610 may have similar features as that discussed above and shown in FIG. 6A. Apertures 620 that surround a securing tab 622 are found above the slots 610 on the lower portion 601 of the bracket 600. The aperture 620/securing tab 622 combination functions in the same manner as discussed above. As with the slots 610, provision of an aperture 620/securing tab 622 on each side of the bracket 600 renders the retrofit system 20 more versatile during installation, but is not required.

The upper portion 602 of the bracket 600 includes an upper flange 630. The flange 630 extends in the opposite direction as that of the bottom flange 603 of the lower portion 601, extending into the cavity of a light fixture housing 10 when mounted. Securing apertures 609 may be found along a portion of the upper portion 602 of the bracket 600, configured to receive fasteners for attachment to the housing 10. Tabs 631 used for securing reflectors 200 may extend from the bottom surface of the upper flange 630. As shown in FIGS. 12-14, a pair of tabs 631 may be found on one side of the upper flange 630 with a twist tab 632 found opposite the tabs 631. The same arrangement may be found on the other bracket 600 utilized in this embodiment of the invention. However, the tabs 631 may be arranged separately or in different groupings and numbers along the upper flange 630, depending on the shape and number of the reflectors used by the retrofit system 20. The upper flange 630 may have reinforcement ribs 633 to prevent its bending. The upper flange 630 may also include multiple socket apertures 634 and 635 that allow for the attachment of different lamp sockets 636 and 637, respectively, as shown in FIG. 14, depending on the type and length of lamp to be installed.

A ballast tray 640 for supporting a ballast 642 may be mounted on the upper flange 630 of a bracket 600. The ballast tray 640 may be mounted by any means that can support the ballast tray 640 with an associated ballast 642 mounted thereon. The ballast tray 640 is preferably, but not necessarily, mounted so as to be pivotable. By pivotally associating the ballast tray 640 with the upper flange 630 of the mounting bracket 600, the ballast tray 640 can be shipped attached to the bracket 600 and positioned underneath the upper flange 630 to reduce the shipping footprint of the retrofit system. The ballast tray 640 may then be pivoted to extend from the mounting bracket 600 during installation, as shown in FIGS. 15 and 16. Additional structure may be provided to ensure that the ballast tray 640 remains extended from the mounting bracket 600. In one embodiment, a locking tab 648 extends from the ballast tray 640 and engages via a snap-fit connection an aperture 638 and indentation 639 (shown in FIGS. 12-14) on the upper flange 630.

An adjustable neck 650 connects the lower and the upper components 601 and 602 respectively, allowing the bracket 600 to be adjusted to a desirable height. The adjustable neck 650 is formed from a first extension 660 of the lower component 601 and a second extension 670 of the upper component 602 that are adjustably secured to one another. As shown in FIGS. 12-14, the first and second extensions are configured to be nested with one another, with the first extension 660 receiving the second extension 670. To assist in the nesting, the extensions 660 and 670 may include nesting flanges 662 and 672 respectively that assist in maintaining the second extension 670 within the first extension 660 and prevent the rotation of either extension. The first and second extensions 660, 670 may be connected to one another using other means. For example, one extension may have a slot and the other extension may have a protrusion or fastener slidably retained within the slot. In another embodiment, the first and second extensions 660 and 670 may have rows of two apertures, with the apertures aligned near the edges of the extensions, preventing the extensions from bending, rotating, or twisting.

Apertures 664, 674 may be found on each of the first and second extensions 660 and 670, respectively. In the preferred embodiment, a plurality of apertures 674 are aligned along the center of the second extension 670. When the first and second extensions are nested, the apertures 664 and 674 are aligned in a linear fashion. By nesting the second extension 670 in the first extension 660, the height of the bracket 100 may be adjusted by moving the bottom component 601 towards or away from the upper component 602. The plurality of apertures 674 on the second extension 670 provides several different height options. When a suitable height is determined, a fastener 680 may engage the aligned apertures 664 and 674 to secure the adjustable neck 650, and the height of the bracket 600. With only the adjustable neck 650 connecting the bottom component 601 to the top component 602, a great deal of space is created within the bracket (particularly between the lower portion 601 and an upper portion 602 of bracket 600). An installer can take advantage of this additional space when maneuvering the lamps during lamp installation, as discussed below.

The mounting brackets 100 and 600, including their respective ballast trays 140 and 640, may be made from a lightweight, thin metal, such as aluminum or steel. While they may be made from various materials, including aluminum, it is preferable, but not required, to use steel to form the brackets and/or ballast trays due to its strength and durability. The same can be said for the reflectors and louver of the retrofit system 20.

Reflectors

FIG. 17-20 illustrate reflectors 200 according to one embodiment of this invention. As shown in FIG. 17, two reflectors 200 are used in the retrofit system 20; however, the system 20 may be configured to use any number of reflectors 200. In one embodiment, each reflector 200 has a channel 202 defined by a base portion 205 and side walls 204, 206. The side walls 204, 206 may be formed to have any angular orientation relative to the base portion 205, depending on the desired light distribution. A flange 203, 207 extends from each of the side walls 204, 206. In one embodiment, side walls 204, 206 are oriented at 45° angles relative to base portion 205, which assists in creating a mix of direct and indirect light. However, in other embodiments, the channel may have a different shape based on the desired light distribution. In some embodiments, the channel 202 may have, but is not limited to, a parabolic or curved shape.

As shown in FIGS. 18 and 19, the reflector 200 has a general rectangular shape for use with rectangular-shaped housings 10. However, the reflectors 200 may have other shapes depending on the shape of the light fixture housing 10 into which they are being mounted. Additionally, the length and width of the reflector 200 may vary depending on the size of the housing 10 into which the reflector is placed. Regardless, the reflectors 200 must be dimensioned to be able to engage mounting brackets 100 when installed, as discussed in more detail below.

The ends 210 of the reflector 200 preferably, but not necessarily, mirror each other, providing more flexibility during installation. An end 210 of the reflector 200 may include an indentation 212 in the base portion 205. These indentations prevent the lateral movement of the reflector 200 when received by the tabs 132 of the bracket 100 to ensure that the reflector 200 remains properly located in the installation. The reflectors 200 may be provided with at least one aperture 216 on one end to facilitate retention of the reflectors 200 in the housing. The aperture 216 may receive a fastener to secure the end of the reflector 200 on the bracket. In some embodiments, twist tabs 632 (discussed in more detail below), as those shown in FIGS. 12-16, may be received by the apertures 216 of the reflectors 200. However, other fastening means, such as, but not limited, metallic ties may be used. When metallic ties are used, the reflectors 200 may have more than one aperture 216, to allow the metallic ties to meet one another to be secured.

Shielding Mechanism

The retrofit assembly preferably also includes a shielding mechanism to help obscure the lamps from sight (entirely or at least partially) and direct the light emitted by the lamps as desired. A variety of different types of shielding mechanisms may be used, including, but not limited to, a traditional louver 30, a frameless louver 300, and a lens assembly 400, all discussed in detail below. FIG. 21 illustrates a traditional louver 30 that includes a plurality of blades and stringers mounted on a separate louver door frame 32. The louver 30 and its frame 32 are typically mounted to the sides of a light fixture via attachment means such as spring clips mounted on the sides of a louver frame that interact with the light fixture housing to secure the louver, with the assistance of hinges (not shown) and cams 34, in place. Given the relatively standard length of lamps, fixture widths vary much more than fixture lengths. Thus, traditional, framed louvers have to be tailored precisely to the dimensions of the housing into which they must fit. More specifically, they have to be sized so that the attachment means on the louver frame sides can interact with the housing to secure the louver in place. Given that louvers must be custom-fitted to a housing, louvers that fit universally within existing fixture housing have been difficult, if not impossible, to offer as part of a retrofit assembly.

FIGS. 22 and 23 illustrate a louver 300 according to one embodiment of this invention. The louver 300 is preferably "frameless," meaning that it does not include a separate louver door frame 32 as described above. Rather, the frame 302 is formed integrally with the louver 300. More specifically, the exterior housing of the louver 300 is defined by side stringers 310 and end blades 320 that form the integral frame 302 for the louver 300. In one embodiment, the bottom edges of the side stringers 310 and end blades 320 are bent to create flange portions 360. These flange portions 360 define the integral frame 302 and increase the rigidity and strength to the louver 300. They also create cleaner edges, thereby enhancing the appearance of the louver 300.

Cross-blades 330 extend between the side stringers 310. Middle stringers may be provided that extend parallel to the side stringers. In the embodiment of FIGS. 22 and 23, two middle stringers 340, 342 oriented at an angle relative to each other to facilitate light distribution extend down the middle of the louver 300 between the end blades 320. Any number of middle stringers and cross-blades may be provided. If only a single light source is provided in the fixture, a middle stringer may be unnecessary. Alternatively, if more than two light sources are to be used, additional middle stringers may be desirable. Collectively, the side stringers, end blades, cross-blades, and optional middle stringers define a series of square or rectangular openings 390 to direct and diffuse light produced by a light source. The louver components may have, but do not have to have, the geometry, surface characteristics and treatments, and orientation to facilitate desired light distribution and may be, but do not have to be, assembled as disclosed in U.S. patent application Ser. No. 11/766,241, entitled "Louver Assembly for a Light Fixture," filed Jun. 21, 2007, the entire contents of which are herein incorporated by reference.

In some embodiments of this invention, the cross-blades 330 and/or end blades 320 are provided with notches 322 along an edge proximate the light source. The notches 322 allow a tubular light source to be positioned lower in the light fixture and thus closer to the opening of the fixture. As shown in the drawings, the notches are configured to receive a tubular light source. However, in other embodiments, the notches may be configured to receive various other light sources, including, but not limited to, u-shaped lamps. This, in turn, enhances overall light fixture efficiency. In such embodiments, the number of notches 322 found on each end or cross blade, 320 and 330 respectively, corresponds to the number of light sources used by the light fixture.

Means are provided on the louver 300 for attaching the louver 300 directly to mounting brackets 100, 600, as opposed to directly to the housing side walls as has been traditionally done. In one embodiment, shown in FIGS. 24-26, at least one hinge 370 extends from each end of the louver 300. The hinges 370 are rigidly formed and are preferably a single component, the importance of which is discussed below. The hinges 370 may be integrally-formed with the louver or alternatively attached to the louver. In the illustrated embodiments, the hinges 370 attach to the flange portions 360 of the end blades 320. In alternative embodiments, the hinges could attach to other portions of the end blades 320. That being said, the hinges 370 need to be positioned so as to be able to engage slots 110 of the mounting brackets 100 during louver installation.

In one embodiment, the hinges 370 include a base portion 372 that is secured to the flange portions 360 of the end blades 320. The base portion 372 may be attached with a fastener, such as, but not limited to, a rivet or a screw, or other fastening means. A hinge arm 374 extends up from the base portion 372 at an approximately 90° angle, but could also extend at other angles. A securing tab 376 extends from the hinge arm 374 at an approximately 90° angle, running parallel to and above (adjacent) the base portion 372 to impart a hook like cross section to the hinge 370, as best seen in FIG. 26. The dimensions of the securing tab 376 are greater than the hinge arm 374 of the hinge 370 as well as the height and/or width of the slots 110 along at least a portion of the advancement sections 112 and the retention sections 113. The interaction between the hinges 370 and the slots 110 will be discussed in further detail below. Alternative hinge configurations are within the scope of the invention so long as such hinges function within slots 110 as discussed below.

Opposite the hinges 370 on the end blades 320 are releasable securing means for securing the free side of the louver 300 to the brackets 100, 600 once the hinges 370 have been secured in slots 110, 610. As shown in FIG. 27, such securing means may be pivoting cam latches 380 designed to engage securing tabs 122 in the mounting brackets 100, 600. Pivoting the cam latches 380 from engaged to disengaged positions with the securing tabs 122, 622 allows the louver 300 to be quickly and easily disengaged from one side of the mounting bracket 100, 600 and swung downwardly to allow access into the fixture for cleaning and maintenance purposes. As stated above, the apertures 120, 620 themselves may be configured to retain the cam latch itself. Securing means other than cam latches 380, such as, but not limited to, latches, spring latches, quarter turn fasteners, pins, screws, and bolts, may be used to secure the louver 300 when closed.

It is preferable, but not required, that the cam latches or other securing means 380 be provided on each end blade 320 on the same side of the louver 300 and that the hinges 370 be provided on each end blade 320 on the same side of the louver 300. In other words, one end of the louver 300 is a mirror image of the other end of the louver 300.

In another embodiment of this invention, the retrofit system 20 may use a lens assembly 400 instead of the louver 300. The lens assembly 400, as shown in FIG. 28, may include a lens 410 and a reflector portion 420 that, in combination with one another, produce a desired light distribution. The lens assembly 400 is defined by opposing ends 430 and opposing sides 440, similar to that of the louver 300. Hinges 470 and releasable securing means, such as cams 480, may be mounted or associated with the opposing ends 430 of the lens assembly, similar to the louver 300. The lens assembly 400 may have, but does not have to have, the geometry, surface characteristics and treatments, and orientation to facilitate desired light distribution and may be, but do not have to be, assembled the same as the lens assembly described in U.S. patent application Ser. No. 11/706,467, entitled "Replacement Light Fixture and Lens Assembly for Same," filed on Feb. 12, 2007, the entire contents of which are incorporated by this reference.

Provision of a frameless louver 300 or lens assembly 400 in the retrofit system 20 imparts a number of advantages. First, the elimination of a frame reduces material and production costs of the louver. The reduction in material also assists in reducing the overall weight of the louver, reducing shipping costs as well as making installation easier. Additionally, a frameless louver such as disclosed herein can fit into more light fixture housings than a louver with a frame. With louver frames being attached directly to the housing of a light fixture as has been traditionally done, the frame must have the same dimensions as the light fixture housing into which it is mounted, limiting the number of fixtures into which the louver frame may be inserted. The louver 300, as discussed above, is connected to the brackets 100, and not the housing of the light fixture, allowing the louver 300 to have smaller dimensions than that of the light fixture housing 10. To the extent that the dimensions of the louver 300 do not precisely match those of the pre-existing housing, gaps between the housing 10 and louver 300 result. These gaps facilitate ventilation of the fixture and thereby reduce the risk of overheating which can detrimentally impact performance.

Installation of an Embodiment of the Retrofit System

While installation of the retrofit system 20 is described and illustrated with a recessed light fixture, the retrofit system 20 can be retrofitted into other types of fixtures, such as surface mounted, suspended, and other types of exposed fixtures. While the retrofit system 20 may be installed by more than one person, the system 20 is designed to accommodate installation by a single person. Before installation begins, the existing fixture must be isolated from any live power source to prevent an injury from occurring. For example, the corresponding power circuit may be opened at a circuit breaker box or at a more local switch. While one of the aims of the retrofit system 20 is to avoid upper access to the ceiling, the existing wiring of the lighting fixture may be disconnected from the main power source. Once the power supply has been deactivated, the light fixture housing 10 can be stripped by disconnecting, removing, and preferably recycling the lamps, lamp sockets, reflectors, wiring connecting the lamp sockets to the ballast, and the ballast. The housing 10 remains positioned in the ceiling, as shown in FIG. 29, with the existing power leads 14 extending through the housing 10 for connection to the ballast of the retrofit system 20. If their presence would not interfere with the installation of the retrofit system 20, the existing components may be left within the housing, but disconnected.

After the original components in the housing 10 have been removed, the mounting brackets 100 are installed. The discussion is focused on installation of mounting brackets 100. However, mounting brackets 600 may be installed in the same way. The mounting brackets 100 are designed to be positioned based off the ceiling, t-grid, or the bottom of the housing. In this way, the retrofit system 20 is positioned independently of the depth or other dimensions of the particular housing. Thus, regardless of the depth of the housing, the lamps are positioned a uniform distance from the ceiling opening to create consistent light distribution. Additionally, a variety of brackets are not needed to match the dimensions of the lighting housings, which significantly reduces manufacturing costs and product complexity.

The brackets 100 may be installed in any order; however, it may be more efficient to install the bracket 100 having the ballast tray 140 on the end closer to the existing wiring of the housing. When installing either bracket 100, as shown in FIG. 30, the bottom flange 102 of the bracket 100 is inserted between the bottom of the housing 10 and t-grid 12 of the ceiling. In a t-grid system, the openings in which housings 10 are placed have a standard width. The brackets 100 are preferably designed to have a width slightly smaller than the openings of the grid system to prevent the bracket 100 from shifting when mounted. With exposed light fixtures, the brackets are aligned along the bottom edge of the light fixture housing. Any number of bracket apertures 109 may be provided in the vertical portion 104 of the mounting bracket 100 so the bracket 100 can be secured to the end wall of the housing 10 by use of a conventional mechanical fastener, such as, but not limited to, a self tapping screw or bolt. In other embodiments, fastener holes can be created upon installation, giving the installer more options as to where the fasteners may be placed. In the case of installing a bracket 600 that has an adjustable neck 650, it is preferable to adjust the height of the bracket 600 before its installation. Once the height is determined, the adjustable neck 650 can be stabilized as discussed above.

Once the bracket 100 with the ballast tray 140 has been secured, the ballast tray 140 can be extended and locked in place. The ballast 142 may then be electrically connected to the existing power leads 14. A splice box 150, as shown in FIG. 31, may be mounted to a surface of the preexisting housing 10 to cover the electrical connection between the existing power leads 14 and the ballast 142. As discussed above, the lamp sockets 106 and ballast 142 are preferably pre-installed on the bracket(s) 100 and electrically-connected together during manufacture. Thus, the installer does not have to devote time or labor to these tasks at the installation site.

Once the brackets 100 have been installed and the wiring completed, the reflectors 200 may be inserted. The reflectors 200 of this system serve three different functions. First, the reflectors efficiently distribute the light produced by the attached lamps. Second, the reflectors improve the aesthetics of the retrofit system 20 by creating a false ceiling that conceals the ballast and associated wiring from view. And third, the reflectors 200 form a wiring enclosure, creating a barrier between the wire for the lamp sockets and the ballasts and the lamps themselves, and thus prevent individuals from being exposed to wires and the associated risk of electric shock upon changing of the lamps utilized by the fixtures.

As shown in FIGS. 32-33, the reflectors 200 are mounted on the brackets 100. A reflector 200 is oriented so that the side walls 204, 206 face downwardly and the base portion 205 is positioned more proximate the upper surface of the housing 10. To secure the reflector 200, a first end of the reflector 200 is slid under the tabs 132 of one of the installed brackets 100 so that tabs 132 are positioned in indentation 212. The reflector 200 is preferably positioned so that fastener aperture 216 on reflector 200 aligns with fastener aperture 134 on mounting bracket 100. A fastener, such as, but not limited to, a quarter turn fastener 240 (see FIG. 35), is then inserted through apertures 216, 134 to secure the second end of the reflector 200 to the mounting bracket 100, as shown in FIG. 34. The same process is used to install the other reflector 200. If the ends of the reflectors are mirror images (i.e., both ends of a reflector may be inserted under tabs 132 and both ends have a fastener aperture 216), the installer may insert either end of the reflector 200 into either end of the housing 10, making the installation process easier and more efficient. However, fasteners are not the only means of securing the reflectors 200 to the mounting brackets 100 and 650. For example, twist tabs 632 may be used, as shown in FIGS. 36-37. The fastener aperture 216 engages the twist tabs 632 when the reflector 200 is installed. Once in place, an arm of the twist tab 632 is pivoted, as shown in FIG. 36 to prevent the twist tab 632 from disengaging from the aperture 216 and retain the reflector 200 in place. Other means, such as, but not limited to, metallic twist ties, and self-tapping fasteners may be used to secure the reflector to the mounting bracket. Once installed, the flanges 203, 207 and side walls 204 and 206 of the reflectors 200 central the housing 10 conceal the ballast tray 140 and its ballast 142. In addition, the flanges 203 and 207 oriented along the side of the housing 10 prevent an installer from accidental entry above the reflectors 200. In the retrofit system 20 that utilizes a lens assembly 400, which includes a reflector portion 420, the reflectors 200 may be, but does not have to be, installed for the safety reasons discussed above.

After both reflectors 200 are installed, the louver 300 (or other shielding mechanism) may be mounted. The louver's length is preferably slightly less than the distance between the installed brackets 100. However, the hinges 370 provided on the louver 30 extend beyond the ends 320 of the louver 300. The combined length of the louver 300 with its hinges 370 may well exceed the distance between the installed brackets 100. Thus, the hinges 370 may prevent the louver from clearing the mounting brackets upon installation, making installation difficult. The hinges 370 may be deformable or spring-loaded to permit the hinges 370 to deform or depress to create sufficient clearance between the louver 300 and brackets 100 during louver installation and then resume their original shape after installation. However, the spring loaded devices are complex and costly. Additionally, the biasing spring holding the hinge or clamp in place could fail, allowing the hinge or clamp to disengage from the brackets, possibly leading to the louver 300 falling from the housing 10.

Figure 38:
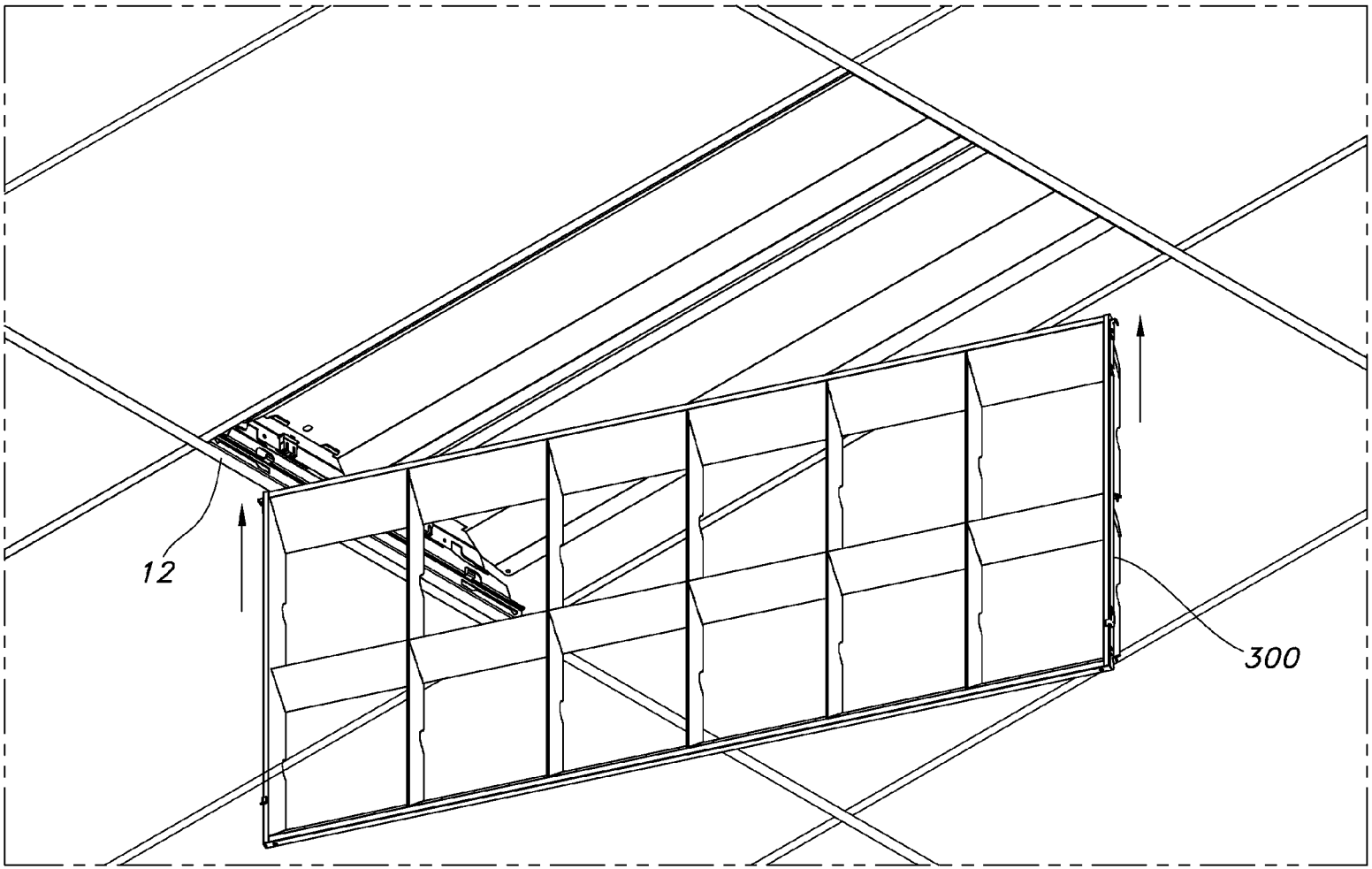

Thus, it is preferable, but not required, that hinges 370 be substantially rigid to retain their shape. In this way, the cost and unreliability of spring loaded devices are avoided. However, since the arms 374 and the securing tabs 376 of the hinges 370 extends past the ends 320 (including the flanges 360 of the end blades 320) of the louver 300, and cannot be retracted or deformed, it may be difficult to insert the louver 300 into the housing in a horizontal orientation. Rather, the side of the louver 300 on which the hinges 370 are associated is initially inserted into the housing diagonally, as shown in FIG. 38.

Figure 39:
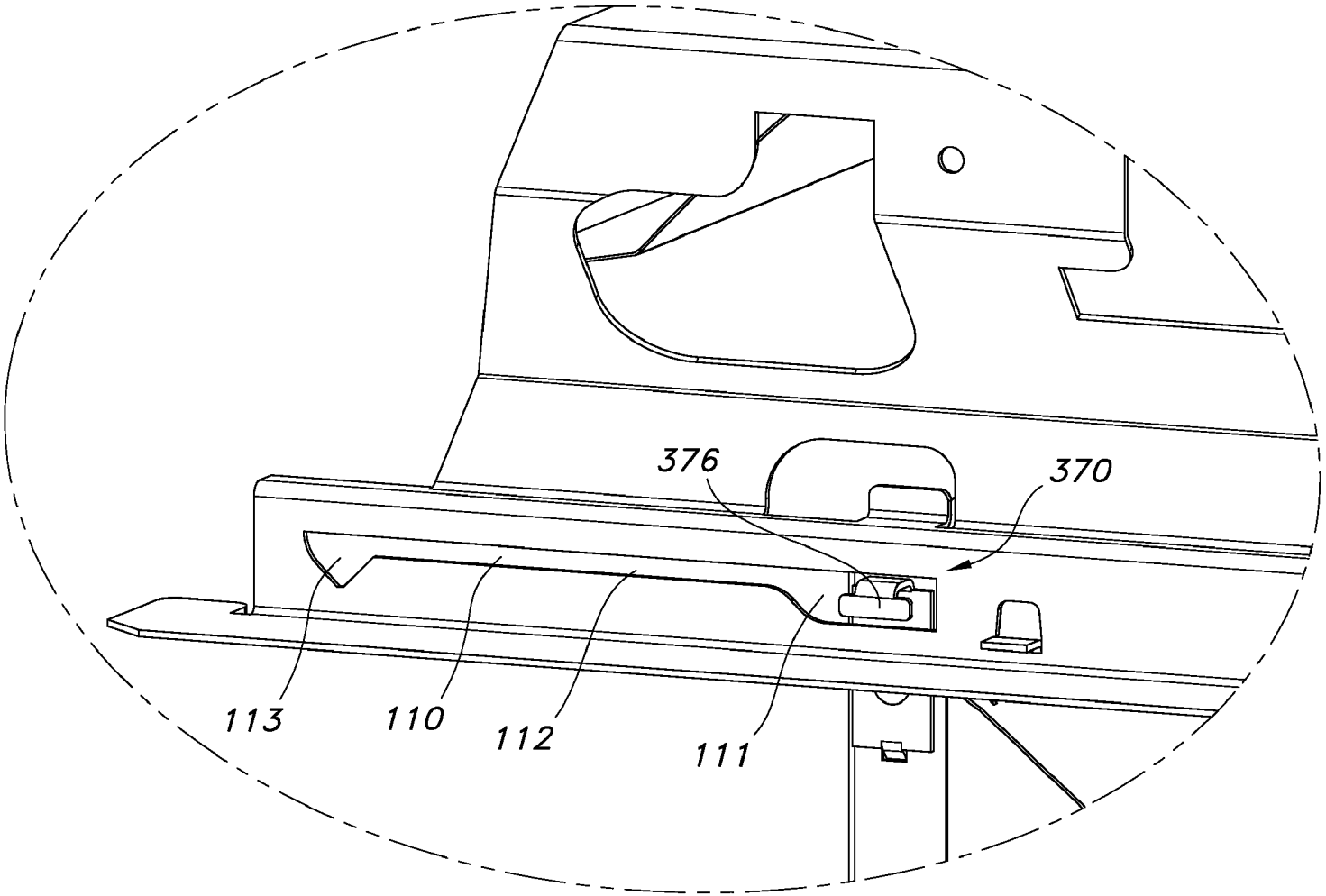
Figure 40:
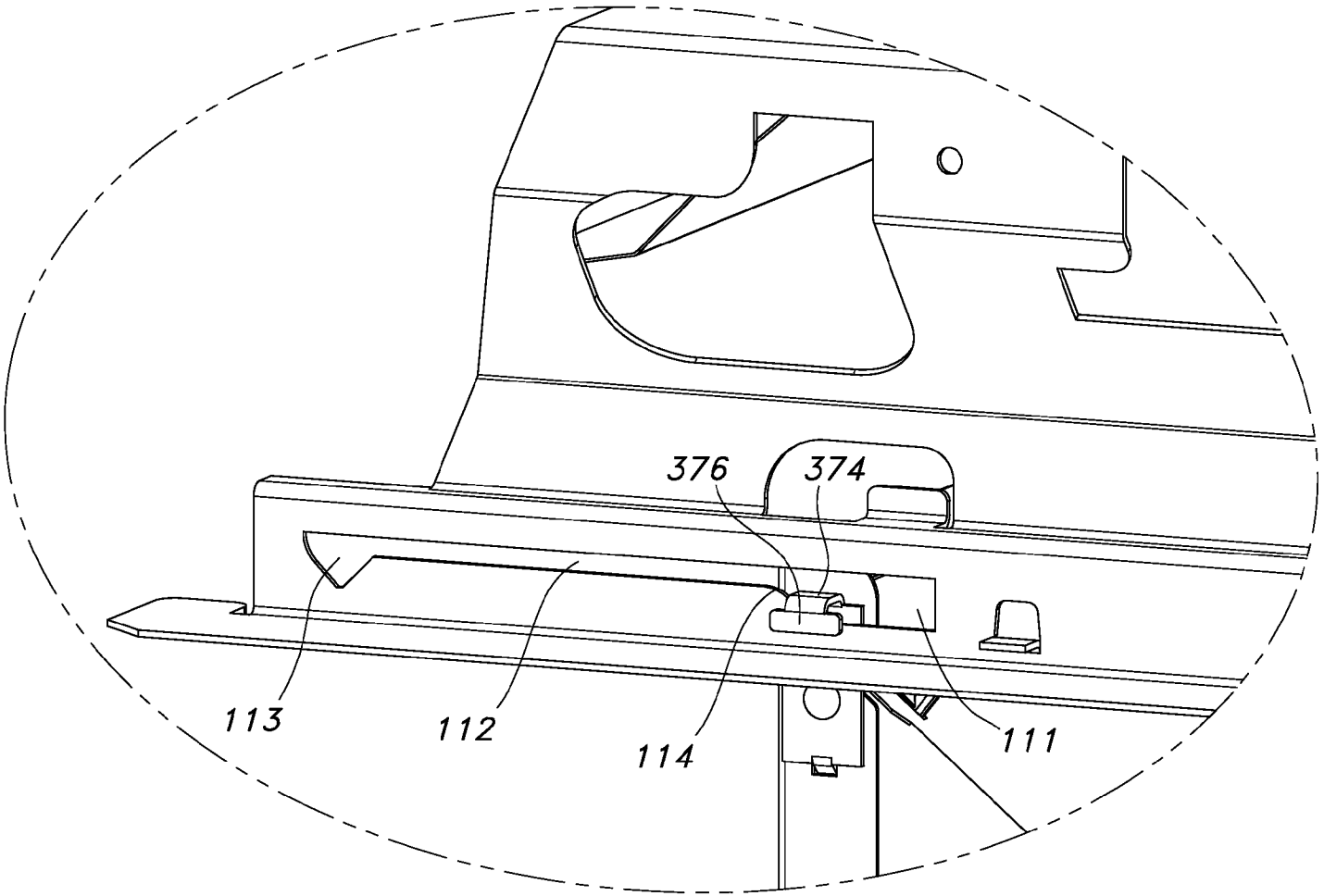
Figure 41:
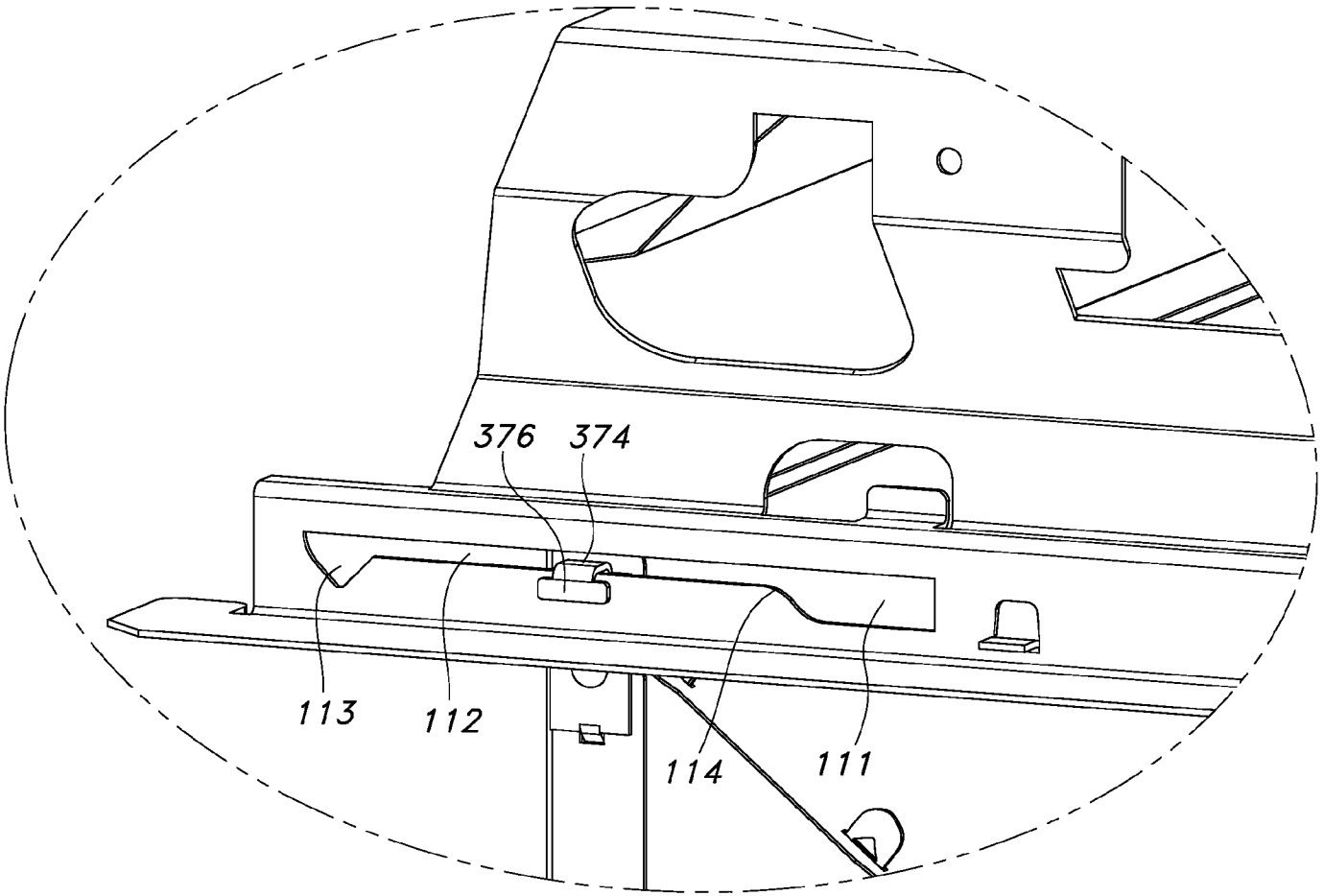

The hinge 370 is then inserted into a slot 110. More specifically, the securing tab 376 of the hinge 370 is inserted into insertion section 111 of slot 110 as shown in FIG. 39. Since the slots 110 in a bracket 100 are mirror-images, the louver may be mounted from either side of the light fixture housing 10, making it easier for the installer when there is limited space to maneuver during installation. The dimensions of the insertion section 111 exceed those of the tab 376 of the hinge 370, permitting insertion of the hinge 370 into the insertion section 111. In case the frameless louver 300 is mishandled, the securing tab 376 can catch a lower edge of the slot 110, acting as a hook, preventing the frameless louver 300 from completely exiting the light fixture housing 10, as shown in FIG. 40. The insertion section 111 provides only a means of access for the hinge 370, and is not designed to permanently house the securing tab 376 and its hinge arm 374. Following insertion of the securing tab 376, the hinge 370 is advanced along the advancement section 112 of the slot, as illustrated in FIG. 40. The height of the tab 376 (measured from the top to bottom of the tab 376 when oriented in the advancement section 112) is greater than the height of the advancement section 112, preventing the tab 376 from exiting the slot 110 during advancement, as shown in FIG. 41. Additionally, the narrow height of the advancement section 112 prevents the hinge arm 374 from rotating, thereby retaining the hinge arm 374 in a relatively horizontal position during advancement. Preventing the hinge arm 374 from rotating prevents the frameless louver 300 from rotating during the advancement of the arm 374, making installation easier.

Figure 42:
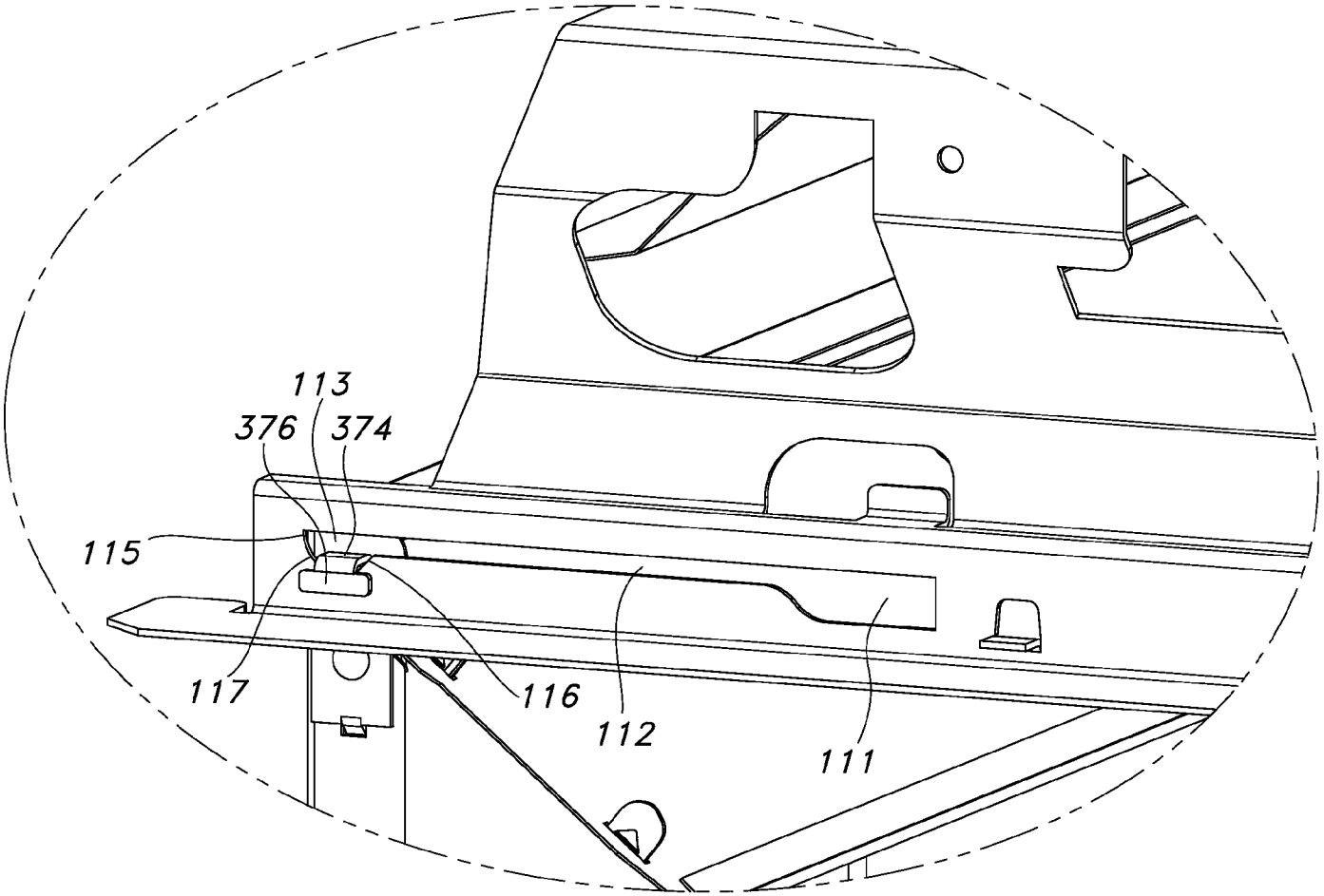

As shown in FIG. 42, the hinge arm 374 continues through the advancement section 112 and seats in the retention section 113. The hinge arm 374 and securing tab 376 may rest along the sloping edges 116 and 117 of the retention section 113 of the slot 110 during installation. The height and width (measured from the left to right of the securing tab 376 when oriented in the advancement section 112) of the securing tab 376 are preferably greater than that of the retention section 113, preventing the tab 376 from exiting the retention section 113. The sloping edge 116 prevents the hinge arm 374 from re-entering the advancement section 112. The other hinge 370 is installed in the same manner.

When both arms 374 of the hinges 370 are received in the retention sections 113 of their respective slots 110, lamps may be mounted into the lamp sockets. Lamps may be mounted before installation of the louver 300, but it is preferable to do so afterwards to avoid the louver damaging the lamps during its installation. Similar to the louver 300, the lamp length needs to be slightly less than distance between the installed brackets 100, which increases the difficulty of installing the lamps. However, the outer installation apertures 107 and inner installation apertures 108 provide spaces for temporary insertion of the ends of the lamps during installation. One end of a lamp can be placed in one of the outer installation apertures 107 while the other end of the lamp travels through the inner installation aperture on the opposite bracket on its way to be received by the lamp socket 106. Once secured, the other end of the lamp exits the outer installation aperture and can be received by the adjacent lamp socket 106. In the case of the adjustable bracket 600, the space adjacent the adjustable neck 650 provides room for lamp installation.

Figure 43:
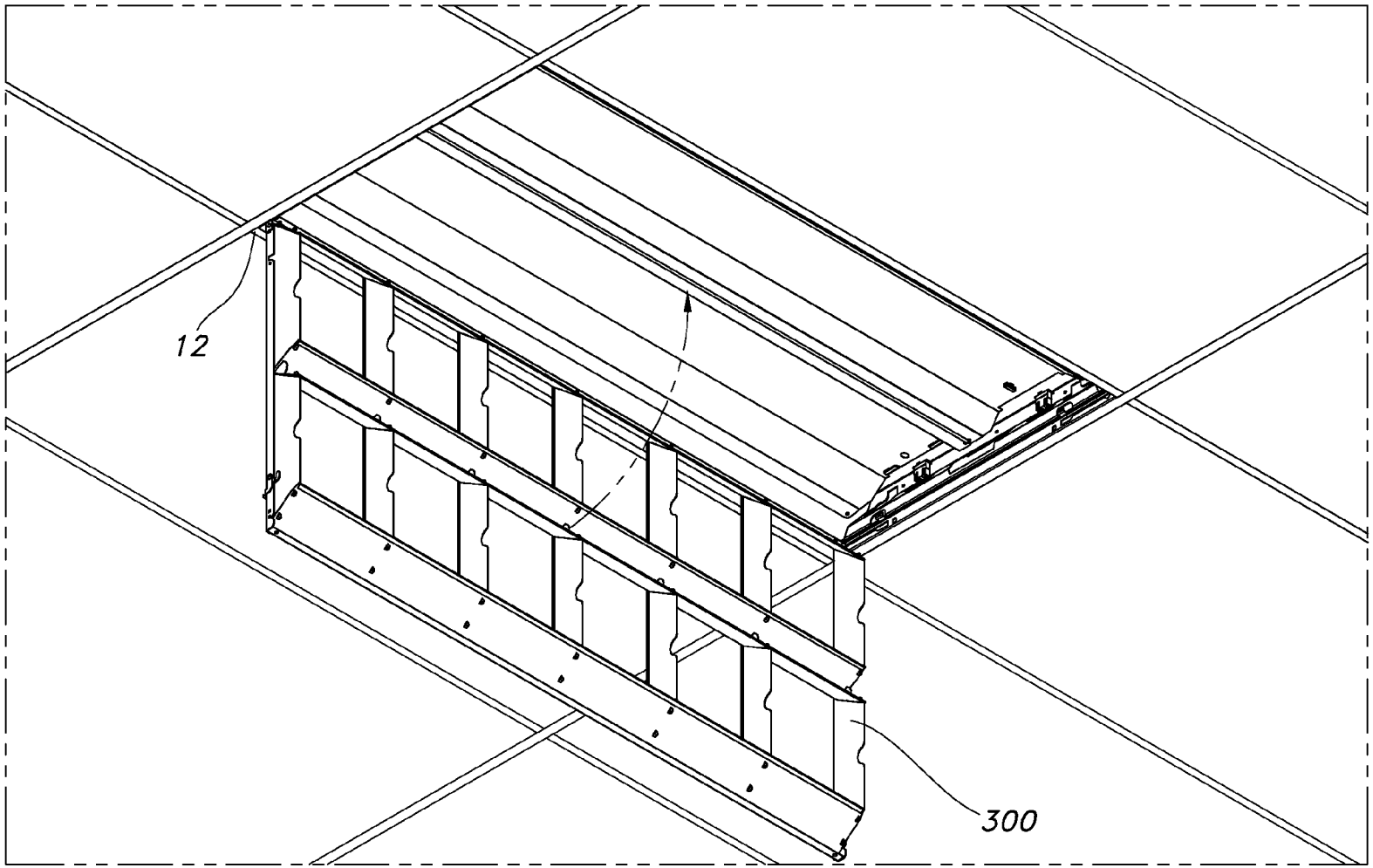
Figure 44:
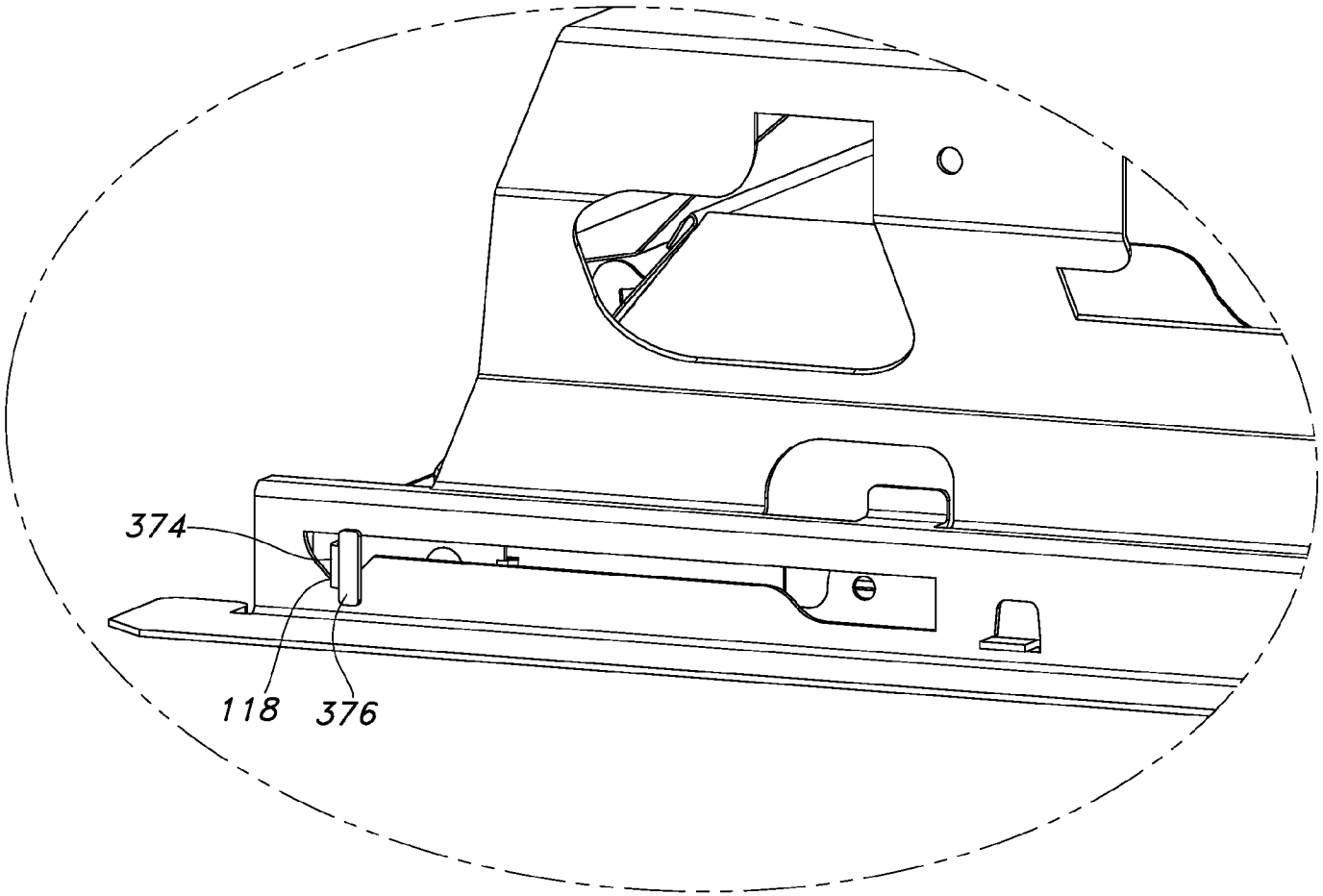

After the lamps are in place, the free end of the louver 300 may be pivoted towards the light fixture housing 10 and secured, as shown in FIG. 43. More specifically, the hinge arms 374 are rotated within the retention sections 113. When the frameless louver 300 is pivoted, the securing tab 376 moves from the horizontal orientation shown in FIG. 42 to the vertical orientation shown in FIG. 44 (i.e., its width as defined above now extends up and down as opposed to left and right). Once pivoted approximately 90°, the hinge arm 374 rests in the vertex 118 of the retention section 113. When the hinge arm 374 is within the vertex 118, the cam 380 is aligned with the securing tab 122. The vertex 118 retains the hinge arm 374, preventing the cam 380 from moving out of alignment when the louver 300 is in the horizontal or closed position. Moreover, the height of the retention section 113 is preferably less than the width of the securing tab 376, preventing disengagement between the two.

Figure 45:
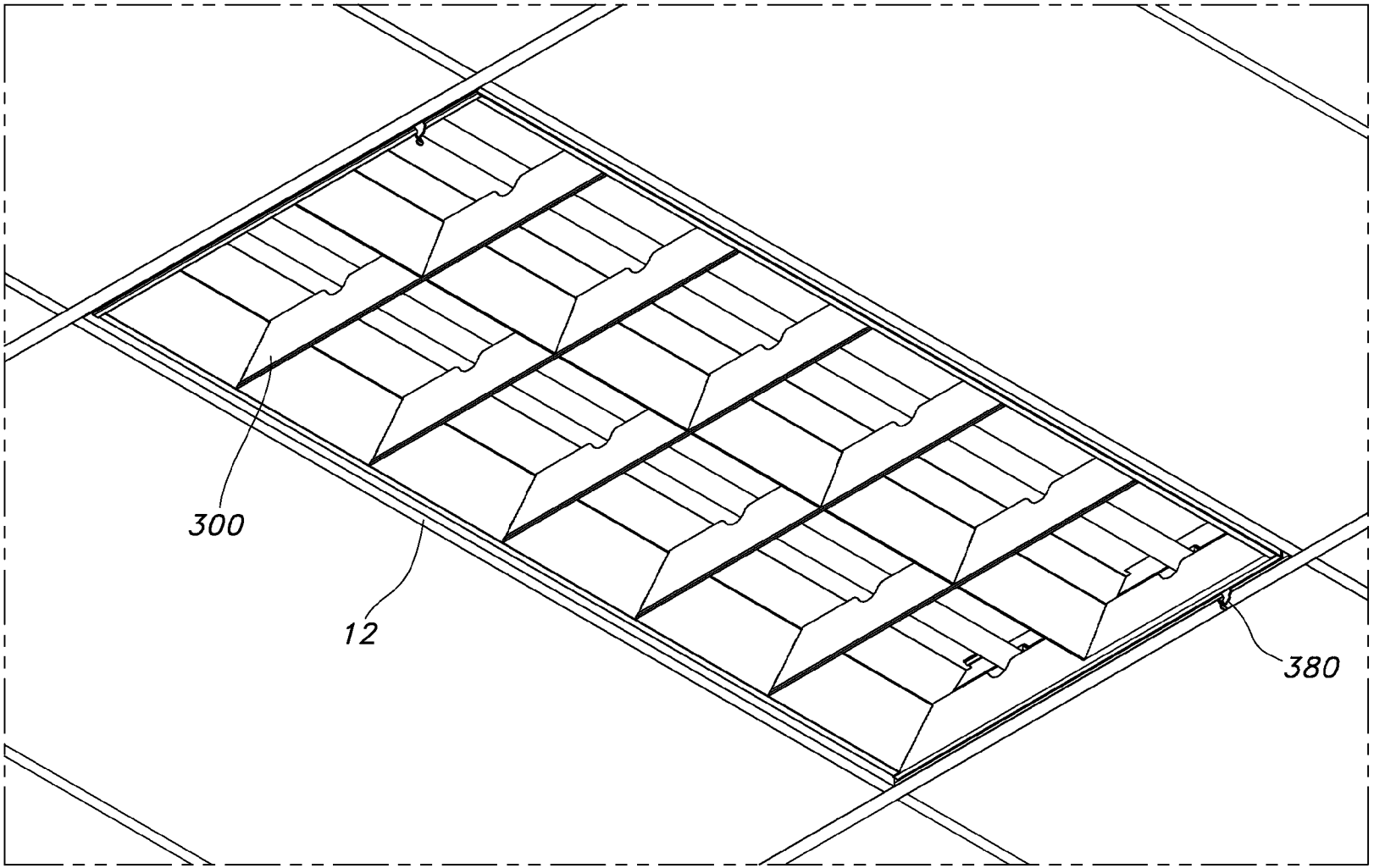

To secure the louver 300 in a closed position as shown in FIG. 45, the cam latches 380 may engage the securing tabs 122 of the brackets in this embodiment of the invention. Because the securing tabs 122 in a bracket 100 are preferably mirror-images, the free end of the frameless louver 300 may be secured in a closed position from either side. In other embodiments, other securing mechanisms, such as, but not limited to, clips, pin clips, fasteners, Velcro, and other means may be used. When lamps need to be replaced or the interior of the light fixture needs to be cleaned, the cam latches 380 may disengage the tabs, allowing the louver 300 to open to provide access within the light fixture housing. Once the louver 300 has been secured, power may be supplied to the light fixture. The same process of installation may be followed when using the lens assembly 400 of FIG. 28. The position of the retention section 113 of the mounting slot 110 on the bracket 100 dictates the relationship between louver 300 or lens assembly 400 and the lamps and reflectors 200 of the retrofit system 20. This relationship determines the light distribution produced by the retrofit system 20. As such, the retention section 113, as well as the slot 110, may be oriented among various positions on the mounting bracket 100 to produce a desired light distribution.

The foregoing is provided for purposes of illustrating, explaining, and describing embodiments of the present invention. Further modifications and adaptations to these embodiments will be apparent to those skilled in the art and may be made without departing from the scope or spirit of the invention.

What is claimed is:

1. A retrofit assembly, for a light fixture with a housing having a first end wall, a second end wall and a bottom edge, the retrofit assembly comprising:

(a) a first mounting bracket and a second mounting bracket for mounting on the first and the second end walls respectively, of the housing, each mounting bracket comprising a flange for positioning adjacent the bottom edge of the housing;

(b) at least one reflector comprising a first end and a second end, wherein the at least one reflector is supported in the housing by the first and the second mounting brackets;

(c) a light shielding mechanism supported by the first and the second mounting brackets;

(d) at least one lamp socket mounted on each of the first and the second mounting brackets; and (e) a ballast tray mounted to one of the first or the second mounting brackets.

2. A retrofit assembly, for a light fixture with a housing having a first end wall, a second end wall and a bottom edge, the retrofit assembly comprising:

(a) a first mounting bracket and a second mounting bracket for mounting on the first and the second end walls respectively, of the housing, each mounting bracket comprising a flange for positioning adjacent the bottom edge of the housing;

(b) at least one reflector comprising a first end and a second end, wherein the at least one reflector is supported in the housing by the first and the second mounting brackets;

(c) a light shielding mechanism supported by the first and the second mounting brackets; and (d) at least one lamp socket mounted on each of the first and the second mounting brackets, wherein the first mounting bracket further comprises at least one tab into which the first end of the at least one reflector is inserted.

3. The retrofit assembly of claim 2, wherein the second mounting bracket further comprises a fastener aperture for receiving a fastener for securing the second end of the at least one reflector thereto.

4. The retrofit assembly of claim 3, wherein the fastener comprises a quarter turn fastener or a twist tab fastener.

5. A retrofit assembly, for a light fixture with a housing having a first end wall, a second end wall and a bottom edge, the retrofit assembly comprising:

(a) a first mounting bracket and a second mounting bracket for mounting on the first and the second end walls respectively, of the housing, each mounting bracket comprising a flange for positioning adjacent the bottom edge of the housing;

(b) at least one reflector comprising a first end and a second end, wherein the at least one reflector is supported in the housing by the first and the second mounting brackets;

(c) a light shielding mechanism supported by the first and the second mounting brackets; and (d) at least one lamp socket mounted on each of the first and the second mounting brackets, wherein the first mounting bracket further comprises a height and wherein the height of the first mounting bracket is adjustable.

6. A retrofit assembly, for a light fixture with a housing having a first end wall, a second end wall and a bottom edge, the retrofit assembly comprising:

(a) a first mounting bracket and a second mounting bracket for mounting on the first and the second end walls respectively, of the housing, each mounting bracket comprising a flange for positioning adjacent the bottom edge of the housing;

(b) at least one reflector comprising a first end and a second end, wherein the at least one reflector is supported in the housing by the first and the second mounting brackets;

(c) a light shielding mechanism supported by the first and the second mounting brackets; and (d) at least one lamp socket mounted on each of the first and the second mounting brackets, wherein the light shielding mechanism comprises a first hinge and the first mounting bracket further comprises at least one mounting aperture for receiving the first hinge.

7. The retrofit assembly of claim 6, wherein the at least one mounting aperture comprises:

(a) an insertion section configured to receive the first hinge;

(b) an advancement section in communication with the insertion section; and (c) a retention section in communication with the advancement section, the retention section configured to retain the first hinge within the at least one mounting aperture.

8. The retrofit assembly of claim 7, wherein the retention section is configured to allow the first hinge to pivot while retained within the retention section.

9. The retrofit assembly of claim 6, wherein the at least one mounting aperture comprises a first mounting aperture and a second mounting aperture, wherein the first and the second mounting apertures are mirror-images.

10. The retrofit assembly of claim 6, wherein the first hinge is rigid.

11. The retrofit assembly of claim 6, wherein the first hinge comprises:

(a) a base mounted to the light shielding mechanism;

(b) an arm extending substantially perpendicular from the base; and (c) a tab extending substantially perpendicular from the arm and substantially in parallel with the base.

12. The retrofit assembly of claim 6, wherein the light shielding mechanism further comprises a second hinge and the second mounting bracket further comprises at least one mounting aperture configured to receive the second hinge.

13. The retrofit assembly of claim 6, wherein the light shielding mechanism further comprises securing means that interacts with the first mounting bracket for retaining the light shielding mechanism in a closed position.

14. A retrofit assembly, for a light fixture with a housing having a first end wall, a second end wall and a bottom edge, the retrofit assembly comprising:

(a) a first mounting bracket and a second mounting bracket for mounting on the first and the second end walls respectively, of the housing, each mounting bracket comprising a flange for positioning adjacent the bottom edge of the housing;

(b) at least one reflector comprising a first end and a second end, wherein the at least one reflector is supported in the housing by the first and the second mounting brackets;

(c) a light shielding mechanism supported by the first and the second mounting brackets, wherein the light shielding mechanism comprises a louver; and (d) at least one lamp socket mounted on each of the first and the second mounting brackets.

15. The retrofit assembly of claim 14, wherein the louver comprises:

(a) an exterior housing defined by at least:

(i) a first end blade;

(ii) a second end blade spaced from the first end blade;

(iii) a first side stringer extending between the first end blade and the second end blade; and (iv) a second side stringer extending between the first end blade and the second end blade and spaced from the first side stringer; and (b) a frame defined by and integrally formed with the first end blade, the second end blade, the first side stringer, and the second side stringer.

16. The retrofit assembly of claim 15, wherein the frame further comprises:

(a) a first end flange integrally formed with the first end blade;

(b) a second end flange integrally formed with the second end blade;

(c) a first side flange integrally formed with the first side stringer; and (d) a second side flange integrally formed with the second side stringer.

17. The retrofit assembly of claim 16, wherein the louver further comprises mounting means positioned on the first end flange and configured to engage a mounting aperture on the first mounting bracket.

18. The retrofit assembly of claim 17, wherein the louver further comprises mounting means positioned on the second end flange and configured to engage a mounting aperture on the second mounting bracket.

19. The retrofit assembly of claim 18, wherein the mounting means positioned on the first and the second end flanges are located more proximate the first side stringer than the second side stringer.

20. The retrofit assembly of claim 17, wherein the louver further comprises releasable securing means positioned on the first end flange opposite the mounting means and configured to engage the first mounting bracket.

21. A retrofit assembly for a light fixture with a housing having a first end wall, a second end wall and a bottom edge, the retrofit assembly comprising:

(a) a first mounting bracket and a second mounting bracket for mounting on the first and the second end walls respectively, each mounting bracket comprising:

(i) a first flange extending in a first direction for positioning adjacent the bottom edge of the housing;

(ii) a vertical portion extending upwards from the first flange and comprising:

(A) two mirror-image mounting slots, each mounting slot comprising:

(I) an insertion section;

(II) an advancement section in communication with the insertion section; and (III) a retention section in communication with the advancement section; and (B) two latch tabs; and (iii) a second flange extending from the vertical portion in a second direction opposite the first direction of the first flange, the second flange comprising reflector retaining means; and (iv) at least one lamp socket;

(b) at least one reflector supported by the first and the second mounting brackets; and (c) a light shielding mechanism supported by the first and the second mounting brackets, the light shielding mechanism comprising:

(i) a first end and a second end spaced from the first end;

(ii) a first side and a second side extending between the first and the second ends;

(iii) a first hinge extending from the first end proximate the first side, wherein the first hinge is adapted to engage at least one of the two mounting slots of the first mounting bracket;

(iv) a second hinge extending from the second end proximate the first side, wherein the second hinge is adapted to engage at least one of the two mounting slots of the second mounting bracket;

(v) a first latch positioned on the first end proximate the second side and adapted to interact with at least one of the two latch tabs of the first mounting bracket; and (vi) a second latch positioned on the second end proximate the second side and adapted to interact with at least one of the two latch tabs of the second mounting bracket.

22. The retrofit assembly of claim 21, wherein the first mounting bracket further comprises a height and the vertical portion of the first mounting bracket further comprises an adjustable neck configured to allow the height of the first mounting bracket to be adjusted.

23. A method of retrofitting a lighting fixture with a retrofit assembly, the lighting fixture including a housing with a first end wall, a second end wall spaced from the first end wall, and a bottom edge, the method comprising:

(a) providing the retrofit assembly comprising:

(i) a first mounting bracket and a second mounting bracket for mounting on the first and the second end walls of the housing respectively, each mounting bracket comprising a first flange for positioning adjacent the bottom edge of the housing;

(ii) a ballast;

(iii) at least one reflector supported by the first and the second mounting brackets;

(iv) a light shielding mechanism supported by the first and the second mounting brackets; and (v) at least one lamp socket mounted on each of the first and the second mounting brackets;

(b) mounting the first and the second mounting brackets to the first and the second end walls of the housing, respectively, by positioning the first flange of the first and the second mounting brackets along the bottom edge of the first and the second end walls of the housing;

(c) mounting the at least one reflector on the first and the second mounting brackets; and (d) mounting the light shielding mechanism to the first and the second mounting brackets.

24. The method of claim 23, wherein the first mounting bracket further comprises a first mounting aperture, wherein the second mounting bracket further comprises a second mounting aperture, and wherein the light shielding mechanism further comprises:

a first end and a second end;

a first side and a second side; and a first hinge and a second hinge positioned on the first and the second ends, respectively, proximate the first side, wherein mounting the light shielding mechanism to the first and the second mounting brackets comprises:

(a) inserting the first hinge into the first mounting aperture; and (b) inserting the second hinge into the second mounting aperture.

25. The method of claim 24, wherein each of the first and the second mounting apertures comprises:

an insertion section;

an advancement section connected to the insertion section; and a retention section connected to the advancement section, wherein inserting the first hinge into the first mounting aperture of the first mounting bracket comprises:

inserting the first hinge into the insertion section of the first mounting aperture; and moving the first hinge from the insertion section to the retention section through the advancement section of the first mounting aperture.

26. The method of claim 25, wherein inserting the second hinge into the second mounting aperture of the second mounting bracket comprises:

inserting the second hinge into the insertion section of the second mounting aperture; and moving the second hinge from the insertion section to the retention section through the advancement section of the second mounting aperture.

27. The method of claim 26, wherein the light shielding mechanism further comprises a first and a second latch positioned on the first and the second ends, respectively, proximate the second side of the light shielding mechanism, wherein mounting the light shielding mechanism further comprises:

(a) pivoting the light shielding mechanism about the first and the second hinges to a closed position within the housing; and (b) engaging the first and the second latches with the first and the second mounting brackets, respectively, to secure the light shielding mechanism in the closed position.

* * * * *